US005579101A

United States Patent [19]

Omata et al.

[11] Patent Number: 5,579,101

[45] Date of Patent: Nov. 26, 1996

[54] DEVELOPER CARTRIDGE AND DEVELOPING APPARATUS

[75] Inventors: Kazuhiko Omata, Satte; Yutaka Ban, Tokyo; Akihito Kanamori, Toride; Kazuyuki Miyano, Tokyo, all of Japan

[73] Assignee: Canon Kabushiki Kaisha, Tokyo, Japan

[21] Appl. No.: 365,126

[22] Filed: Dec. 28, 1994

[30] Foreign Application Priority Data

Dec. 28, 1993 [JP] Japan ..... 5-335536

[51] Int. Cl.[6] ..... G03G 15/00

[52] U.S. Cl. ..... 355/260; 222/DIG. 1; 355/245

[58] Field of Search ..... 355/260, 298, 355/245, 200, 210; 222/DIG. 1, 325, 485, 160, 167, 169; 118/653

[56] References Cited

U.S. PATENT DOCUMENTS

| | | | |
|---|---|---|---|
| 4,696,418 | 9/1987 | Kurotaka et al. | 222/167 |
| 4,981,218 | 1/1991 | Ban et al. | 206/633 |
| 5,078,303 | 1/1992 | Kikuchi et al. | 222/167 |
| 5,084,734 | 1/1992 | Yoshino et al. | 355/260 |
| 5,111,976 | 5/1992 | Ban | 222/485 |
| 5,268,722 | 12/1993 | Ikkatai et al. | 355/260 |
| 5,331,382 | 7/1994 | Miura et al. | 355/260 |
| 5,351,728 | 10/1994 | Ban et al. | 141/364 |
| 5,424,816 | 6/1995 | Fox et al. | 355/260 |

FOREIGN PATENT DOCUMENTS

| | | |
|---|---|---|
| 62-86382 | 4/1987 | Japan . |
| 62-170987 | 7/1987 | Japan . |
| 63-62857 | 4/1988 | Japan . |
| 63-188665 | 12/1988 | Japan . |
| 5-64803 | 3/1993 | Japan . |

*Primary Examiner*—Sandra L. Brase
*Assistant Examiner*—T. A. Dang
*Attorney, Agent, or Firm*—Fitzpatrick, Cella, Harper & Scinto

[57] ABSTRACT

A developer cartridge detachably mountable to a developing apparatus having a shutter for closing and opening a developer receiving opening, includes a cylindrical portion for accommodating a developer, the cylindrical portion being provided with an opening extending along a length thereof; a sealing member for sealing the opening; a first projection for moving the shutter to an open position for the developer receiving opening in interrelation with rotation of the developer cartridge in a first direction; and a second projection for moving the shutter to a close position for the developer receiving opening in interrelation with rotation of the developer cartridge in a second direction which is opposite from the first direction.

42 Claims, 13 Drawing Sheets

DEVELOPER CARTRIDGE AND DEVELOPING APPARATUS

FIELD OF THE INVENTION AND RELATED ART

The present invention relates to a developing apparatus for developing an electrostatic image on an image bearing member in an image forming apparatus such as a copying machine or printer and a developer cartridge for supplying a developer for the developing apparatus.

In an image forming apparatus such as an electrophotographic copying machine or a laser beam printer, a photosensitive drum is uniformly charged and then exposed to a selective light to form a latent image thereon. The latent image is developed with a developer into a visualized image, and the visualized image is transferred onto a transfer material. In such an apparatus, the developer is required to be resupplied each time it is used up. A toner cartridge for supplying new developer into the developing apparatus is classified as either a so-called replenishing type wherein all the developer therein is once supplied into a developer receptor in the main assembly of the image forming apparatus, or a so-called installation type wherein the cartridge is installed in the image forming apparatus after it is mounted therein, and the developer therein is supplied out gradually into the developing apparatus until the developer therein is used up.

Because of the recent demand for downsizing of the apparatus, the installing type cartridge is preferred. Particularly, a type has become widely used wherein the cartridge is in the form of a cylinder having a developer supplying longitudinal opening in the form of a slit, the cartridge is rotated to direct the opening horizontally rather than downwardly, and the developer is scooped up, as disclosed in Japanese Laid-open Patent Applications Nos. 86382/1987, 170987/1987 and Japanese Laid-open Utility Model Applications Nos. 62857/1988 and 188665/1988, for example.

The reason for using such an arrangement is that the latitudes of the toner cartridge location and the developing apparatus location are increased from the standpoint of downsizing and from the standpoint of supplying a required and sufficient amount of the developer into the developing apparatus to maintain a constant amount of the developer in the developing apparatus, and from the standpoint of maintaining a constant toner/carrier ratio in the case of a two component developer.

In such an image forming apparatus, a shutter is generally used to permit communication between the developer discharge opening and an opening of a developer chamber when the toner cartridge is mounted and to prevent reverse flow of the toner from the developer chamber when the toner cartridge is not mounted on the apparatus.

In a shutter disclosed in Japanese Laid-open Utility Model Application No. 62857/1991, a slit opening extending in a longitudinal direction is provided, and engaging portions at the opposite ends of the toner cartridge are inserted into the shutter opening to permit rotation of the shutter with rotation of the toner cartridge.

Only one such engaging portion is provided in the circumferential direction to close and open the shutter with the result of a large load imparted to the engaging portion, which leads to the problem of damage to the engaging portion and deformation of the engaging portion.

A projection engageable with a slit opening of the shutter is on an extension of the slit opening of the toner cartridge, and therefore, upon opening and closing of the shutter, a toner cartridge twisting force is imparted to promote the deformation of the cylindrical member.

SUMMARY OF THE INVENTION

Accordingly, it is a principal object of the present invention to provide a developer cartridge and a developing apparatus wherein the load imparted to a projection for opening and closing the shutter is reduced.

It is another object of the present invention to provide a developer cartridge wherein deformation of the cylindrical shape is prevented.

According to an aspect of the present invention, there is provided a developer cartridge detachably mountable to a developing apparatus having a shutter for closing and opening a developer receiving opening, the developer cartridge comprising: a cylindrical portion for accommodating a developer, the cylindrical portion being provided with an opening extending along a length thereof; a sealing member for the opening; a first projection for moving the shutter to an open position for the developer receiving opening in interrelation with rotation of the developer cartridge in a first direction: a second projection for moving the shutter to a close position for the developer receiving opening in interrelation with rotation of the developer cartridge in a second direction which is opposite from the first direction.

According to another aspect of the present invention, there is provided a developer cartridge comprising: a cylindrical portion for accommodating a developer, the cylindrical portion being provided with an opening extending in a direction of length of the cylindrical portion; first and second projections extending out of an outer surface of the cylindrical portion; wherein the first projection and second projection are disposed interposing an extension of the opening therebetween at positions away from the extension.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Referring to the accompanying drawings, the preferred embodiment of the present invention will be described.

Figure 1:
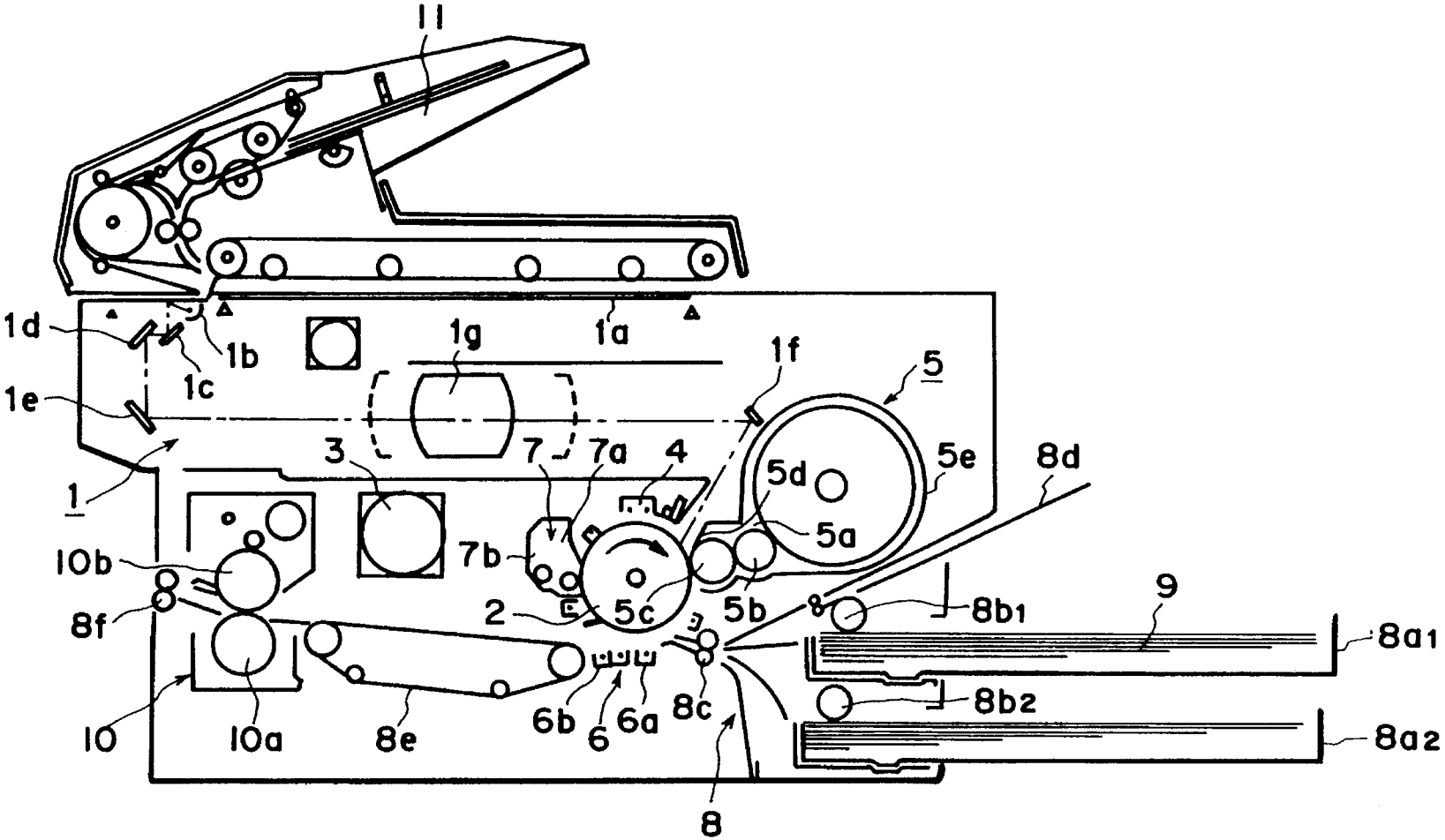
FIG. 1 is a sectional view of a copying machine according to an embodiment of the present invention.

FIG. 1 shows an electrophotographic copying machine as an exemplary image forming apparatus using a developer cartridge and developing apparatus according to an embodiment of the present invention.

In FIG. 1, the image forming apparatus comprises an image reader 1 having an original supporting platen glass 1*a*, which is illuminated by an illumination lamp 1*b*. The original is scanned by the lamp 1*b* and scanning mirror 1*c*. The light reflected by the original is projected onto a photosensitive drum 2 through the mirror 1*c*, reflection mirrors 1*d*, 1*e* and 1*f*, and a focussing lens 1*g* having a magnification changing function.

The photosensitive drum 2 has a surface photosensitive layer, and is rotated by a main motor 3 in a direction indicated by an arrow in FIG. 1 during image forming operation. Around the photosensitive drum 2, there are a charging device 4, developing device 5, transfer device 6 and cleaning device 7. The surface of the rotating photosensitive drum 2 is uniformly charged by the charger 4, and the photosensitive drum 2 is exposed to a light image from the reader 1 so that an electrostatic latent image is formed on the photosensitive drum 2. The latent image is developed by the developing device 5 by transferring a developer, which will hereinafter be called "toner", to the electrostatic latent image.

The developing device 5 supplies the toner from a developer chamber 5*a* to a developing sleeve 5*c* containing therein a fixed magnet by a developer blade 5*b*. The developing sleeve 5*c* is rotated so that a layer of toner is formed on the surface of the developing sleeve 5*c* while triboelectric charge is applied to the toner by the developer blade 5*b*. The toner is transferred to the photosensitive drum 2 in accordance with the electrostatic latent image, thus visualizing the latent image into a toner image.

The toner image is transferred onto a recording material 9 fed by a sheet feeder 8 with a transfer voltage applied to the transfer device 6. The transfer device 6 has a transfer charger 6*a* and a separation charger 6*b*. By application of a voltage of a polarity opposite from that of the toner by the transfer charger 6*a*, the toner image is transferred onto the recording material 9. After the transfer, a voltage is applied to the recording material 9 by the separation charger 6*b* to separate the recording material 9 from the photosensitive drum 2.

After the image transfer, toner remaining on photosensitive drum 2 is removed by a cleaning blade 7*a*, and the removed toner is collected into a collected toner container 7*b* in the cleaning device 7.

On the other hand, a sheet feeder 8 has a top and bottom cassettes 8*a*1 and 8*a*2 at a bottom part of the main assembly of the apparatus. The recording material contained in these cassettes is fed out one by one by respective pick-up rollers 8*b*1 and 8*b*2 to a pair of registration rollers 8*c*. Additionally, there is provided a manual feeder 8*d*. The recording material 9 fed out of the cassette or the manual feeder is fed to the registration rollers 8*c*, and receives the toner image from the photosensitive drum 2.

The recording material 9 after the transfer operation is fed to an image fixing device 10 by a conveyer belt 8*e*. The fixing device comprises a driving roller 10*a* and a heating and pressing roller 10*b* containing therein a heater. The transferred image is fixed by application of heat and pressure by the fixing device 10. Then, the recording material 9 is discharged to the outside of the apparatus by a pair of discharging rollers 8*f*.

The copying machine of this embodiment has an automatic document feeder 11 above the original supporting platen 1*a*, so that originals are automatically fed one by one. The document feeder used may be one of any known types.

Toner Cartridge

Figure 2:
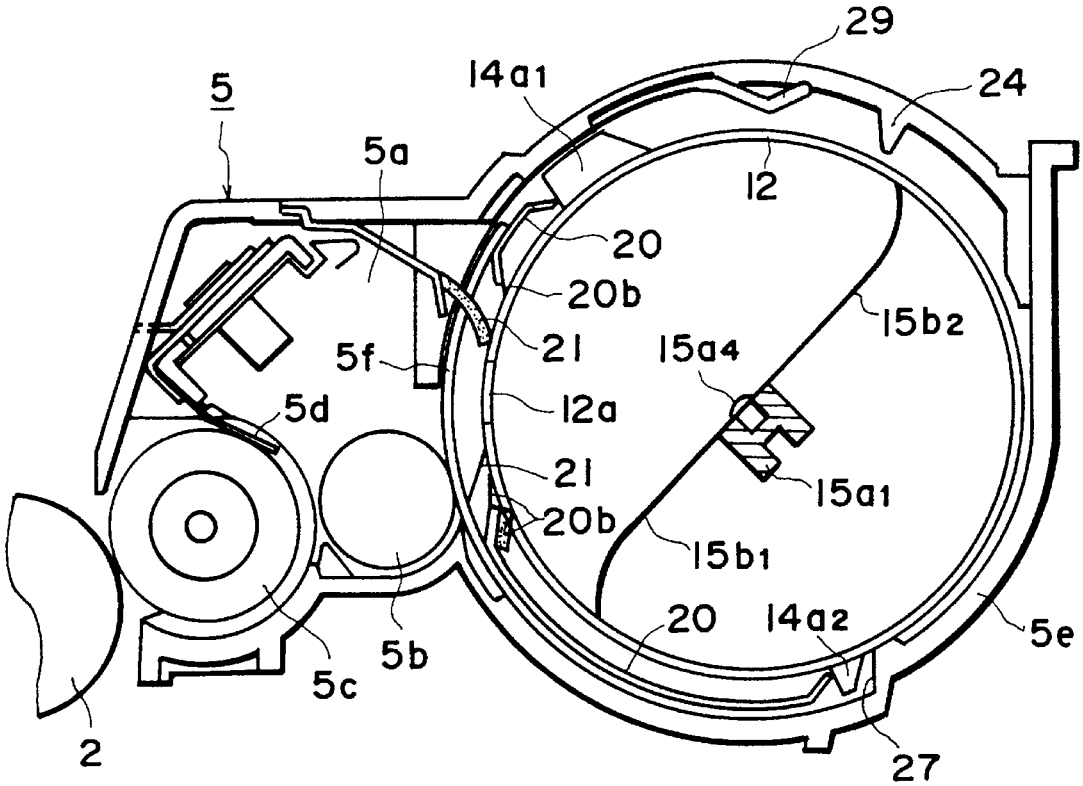
FIG. 2 is a sectional view of a developing apparatus.
Figure 3:
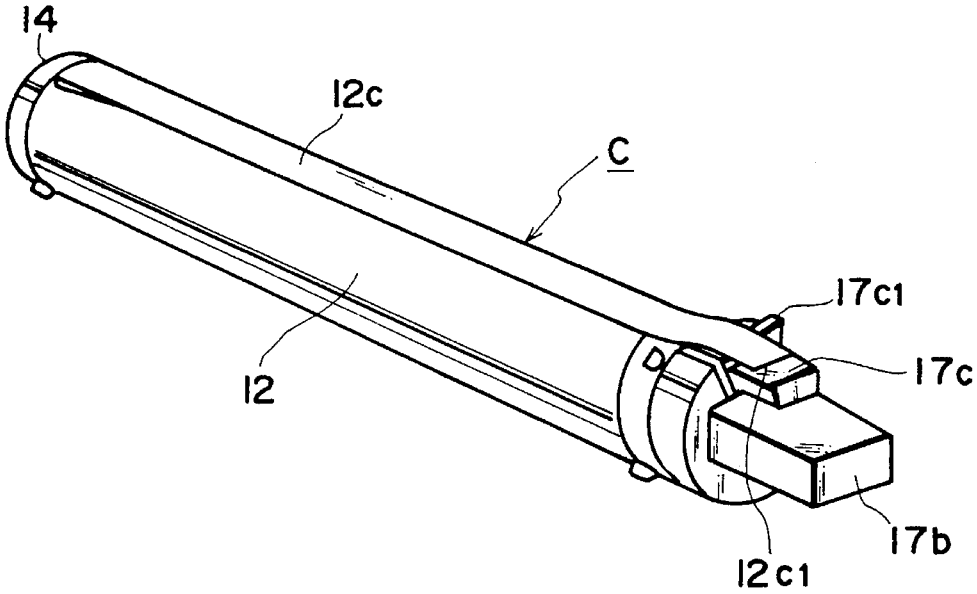
FIG. 3 is a perspective view of a toner cartridge.

A description will be made as to a toner cartridge C. As shown in FIGS. 2 and 3, the toner cartridge C is mountable to a cartridge mount 5*e* of the developing device 5, and is kept there. It gradually supplies the toner into developer chamber 5*a*

Installing or Built-in Type

Figure 4:
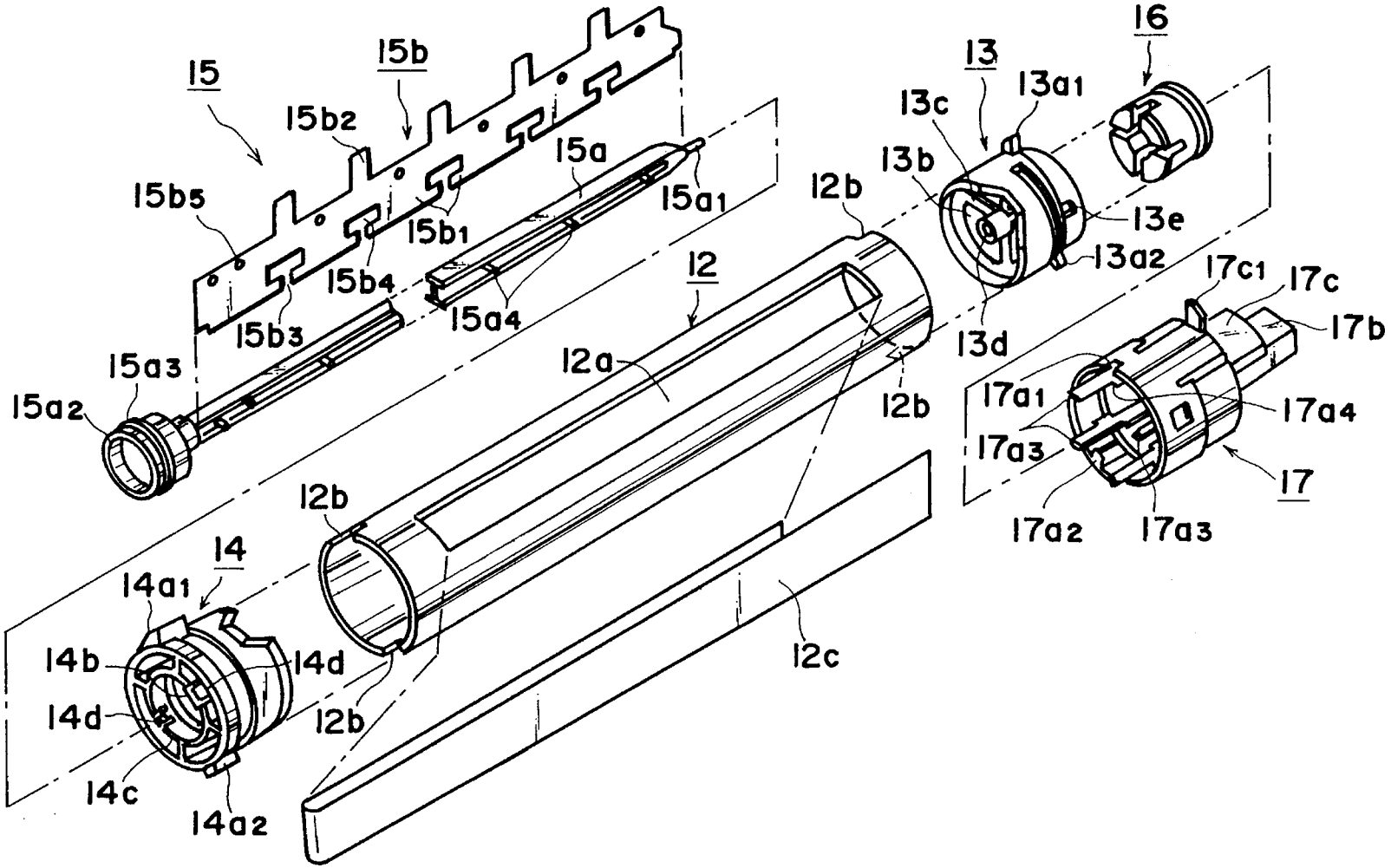
FIG. 4 is an exploded view of a part of a toner cartridge.

The toner cartridge C comprises, as shown in FIG. 4, a toner replenishing container 12, a flange 13, a flange 14, a stirring member 15, a cap 16, and a grip 17. Each part will be described in detail.

Toner Replenishing Container 12

As shown in FIG. 4, it is generally cylindrical (here, "cylindrical" is not limited to having a circular cross-section but covers a polygonal cross-section). It is provided with a toner discharge opening (slit or slot) 12*a* extending in a longitudinal direction thereof and cut-away portions 12*b* at each of the opposite longitudinal ends for engagement with a projection of a flange 13 or flange 14 for the purposes of positioning.

The inner length of the toner replenishing container 12 is preferably approx. 160–400 mm, more preferably approx. 180–330 mm, and most preferably approx. 200–310 mm.

If it is smaller than 160 mm, then toner supplied into the developer chamber 5*a* does not extend throughout the length of the developing sleeve 5*c*, resulting in a tendency to drop-out toner in a resultant image. If it is larger than 400 mm, then the length of the developing device 5 is too large to downsize it. The size R is determined in accordance with the size of the sheets usable with the apparatus (A3, A4, B4).

The inner radius of toner replenishing container 12 is preferably approx. 10–50 mm, and more preferably approx. 15–35 mm, and most preferably approx. 25–30 mm.

If it is smaller than 10 mm, the power of stirring member 15 (particulation of caked toner and feeding of the toner into the developer chamber 5*a*) is not sufficient. If it is larger than 50 mm, the torque required by the stirring member 15 is too large.

In this embodiment, the toner replenishing container 12 has an inner radius of 55 mm, a wall thickness of 0.8 mm, and an inner length of the cylinder of 297.5 mm. The toner discharge opening 12*a* has a length of 296 mm which is generally equal to the length of the toner replenishing container 12, and a width of 7 mm.

In terms of the stirring member 15, the dimensional accuracy of the inner radius and the circularity is high. For this reason, the material of the toner replenishing container 12 is preferably a thermoplastic resin material. ABS resin and polyester resin are preferable because they are easy to manufacture with high dimensional accuracy, because they are relative less expensive, and because they are strong against impact, such as falling. Next, anti-impact polystylene resin (HIPS) is preferable. Beside these materials, paper or aluminum or the like is usable.

As a method of manufacturing the toner replenishing container 12 using thermoplastic resin material, it is preferable to form the toner discharge opening 12*a* and the cut-away portions 12*b* by pressing after extrusion. More preferably, inner sizing (cooling core type) is carried out to improve the inner diameter accuracy and circularity. Most preferably, injection molding is used, since its accuracy is higher than extrusion. Then, deformation due to hysteresis does not occur even if a heat seal for a sealing film or hot melt fusing of the flange 13 and flange 14 are effected.

When injection molding is used, it is preferable that one of the flanges is integrally molded with the cylindrical portion, as disclosed in Japanese Laid-open Patent Application No. 64803/1993, since then the number of parts and the manufacturing steps can be saved. In this case, an injection pressure of 500–1500 Kgf/cm$^2$ and a filing time of 0.005–0.02 sec is preferable.

The toner discharge opening 12*a* of the toner replenishing container 12 is sealed by a seal 12*c*. The seal 12*c* is removed by an operator upon start of use of the toner cartridge C.

The seal 12*c* is in the form of a flexible film of laminations of polyester resin, Nylon, polyethylene resin, ethylenevinylacetate. It has a thickness of approx. 50–200 microns, preferably 10–150 microns. The seal 12*c* is fixed to the toner replenishing container 12 with a strength sufficient that toner does not leak during transportation due to temperature change, pressure change, vibration, falling, impact or the like, and such that the peeling is permitted upon use. The peeling strength is preferably not more than 10 kgf at the max., more preferably not more than 6 kgf, and most preferably not more than 4.5 kgf, when the seal 12*c* is folded back at an angle of 180 degrees and pulled in a longitudinal direction.

As a method of fusing the seal 12*c* to the toner replenishing container 12, hot plate fusing, impulse sealing, ultrasonic wave fusing, and high frequency fusing are preferable. Among these, hot plate fusing is preferable.

The total length of the seal 12*c* is not less than twice the length of the toner discharge opening 12*a*. A part thereof not bonded to the toner replenishing container 12 is folded back at 180 degrees to provide a pulling portion, which is lightly fixed by hot melt bonding agent, double sided adhesive tape or the like on a fixed portion of the seal 12*c*, toner replenishing container 12, flange 13 or grip 17.

The flange 13 and flange 14 are mounted to the respective ends of the cylindrical portion of the toner replenishing container 12, and they are manufactured through injection molding using ABS resin, polyester resin, HIPS or another thermoplastic resin material. The flange 13 and flange 14 each have two projections, i.e. 13*a*1 and projection 13*a*2 and, projection 14*a*1 and projection 14*a*2 respectively. The projections are engaged with the cut-away portions 12*b* of toner replenishing container 12.

One of the flanges, i.e., flange 13 is provided with a filling opening 13*b* for permitting toner to feed therethrough. Inside the filling opening 13*b*, a cross rib 13*c* is formed, and a bore 13*d* for receiving the stirring member 15 is formed at the center of the cross rib 13*c*. It is preferable that the diameter of the filling opening 13*b* is not less than 50% of the inside diameter of the toner replenishing container 12, and more preferably not less than 60% from the standpoint of improving the filling period and filling efficiency.

Another flange, i.e., flange 14 is provided with a bore 14*b* for receiving stirring member 15, and around the bore 14*b*, there is a jaw 14*c* for supporting an outer periphery of a gear 15*a*2 of the stirring member 15. The jaw 14*c* is provided with a claw 14*d* for engagement with a ring rib 15*a*3 of the gear 15*a*2.

Flange 13 and flange 14 are engaged with the respective ends of the toner replenishing container 12 having the seal 12*c*. The engaging method may be with hot melt bonding, ultrasonic wave fusing, or adhesive tape. Particularly, hot melt bonding is preferable because sufficient sealing and bonding strength can be provided without difficulty. Additionally, a method of applying a hot meld melt bonding material to an inner surface of the toner replenishing container 12 is preferable, since there is no liability of outside projection of the bonding material.

Heights of projection 13*a*1, projection 13*a*2, projection 14*a*1 and projection 14*a*2 of the flange 13 and flange 14 respectively and a relation with the toner discharge opening 12*a* will be described hereinafter.

Stirring Member 15

Figure 5:
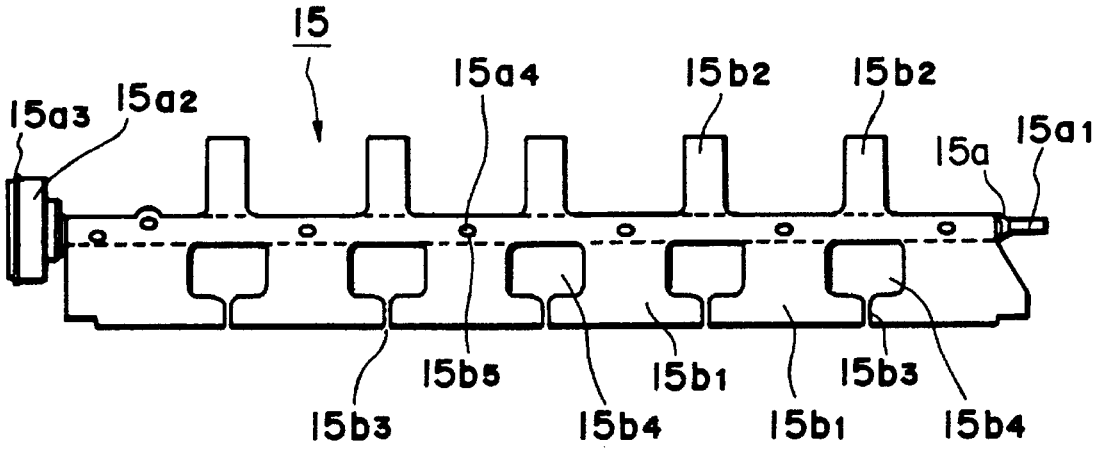
FIG. 5 illustrates a stirring member.

As shown in FIGS. 4 and 5, the stirring member 15 comprises a stirring shaft 15*a* and a stirring blade 15*b*.

Stirring Shaft 15*a*

The stirring shaft 15*a* is in the form of a rod having an "H" cross-section, for example. At one longitudinal end thereof, a portion 15*a*1 to be received by a bore 13*d* of the flange 13 is formed, and at the other end, the gear 15*a*2 is formed for connection with a driving system. The gear 15*a*2 has a ring rib 15*a*3 at the outer periphery. Press-fitting bosses 15*a*4 are formed for supporting stirring blade 15*b*.

It is important that the stirring shaft 15*a* has a sufficient straightness, and therefore, the stirring shaft 15*a* has a generally "H", "L", "T" or the like cross-section to prevent bending, and particularly "H" is preferable.

The material of the stirring shaft 15*a* is preferably polyacetal (POM) in consideration of the sliding property at the bearing portions and anti-creep. As the manufacturing method thereof, injection molding is preferably used from the standpoint of easy manufacturing.

Stirring Blade

The stirring blade 15*b* to be mounted to the stirring shaft 15*a* is provided with a projection projected at least in two directions from the shaft 15*a*. In this embodiment, it comprises a major blade portion 15*b*1 and auxiliary blade portion 15*b*2 in two directions. The major blade portion 15*b*1 has an end portion over the entire length of the shaft 15*a*, and there are provided slits 15*b*3. In communication with the slits 15*b*3, there are provided rectangular holes 15*b*4. The auxiliary blade portion **15*b*2 has an end surface at a position corresponding to the slit 15*b*3**.

At a longitudinally central portion of the blade **15*b*, a plurality of press-fitting bores 15*b*5 are provided to receive the boss 15*a*4 of the stirring shaft 15*a***.

As the material for the stirring blade **15*b*, it preferably shows proper elasticity and proper anti-creep, for example, a polyurethane rubber sheet, or a cloth coated with rubber, and a particularly preferable material is a polyester (PET) film. It preferably has a thickness of approx. 50–500 μm, most particularly approx. 150–300 μm. If it is smaller than 50 μm, the elasticity is not enough resulting in a lower toner feeding force. If it is larger than 500 μm, the elasticity is too strong resulting in a large torque being required to rotate the stirring blade 15*b* in contact with the inner surface of the container 12**. In this embodiment, the thickness is approx. 188 μm.

As the manufacturing method for the stirring blade **15*b***, the above-described material is stamped out by pressing, since it is of high accuracy without high cost.

The stirring shaft and stirring blades **15*b* thus manufactured are integrated by inserting the boss 15*a*4 into the bore 15*b*5, and press-fitting them by heat or ultrasonic wave. The stirring member 15 is inserted into the container 12, and the opposite ends thereof are supported by the flanges 13 and 14 to permit the rotation thereof. The method of mounting the stirring member 15 will be described hereinafter. A description will be made as to the shape of the stirring blade 15*b*. It is preferable that the stirring blade 15*b* projects from the stirring shaft 15*a* in at least two directions. Particularly, it is preferable as in this embodiment that the blade extending in the two directions has different lengths of tangent line with respect to the internal wall surface of the container 12. One of the main blade portions 15*b*1 is provided with a plurality of slits 15*b*3 but it still extends over the entire length of the blade 15*a*, and therefore has a sufficient restoring force and therefore has a high toner feeding power. In addition, the slits 15*b*3 and the holes 15*b*4 are effective to prevent increase of the torque. The auxiliary blade portion 15*b*2 extends only at the portion corresponding to the slit 15*b*3 and the holes 15*b*4**, and are effective to reduce the remaining amount of toner. By doing so, if a comparison is made with a blade portion extended uniformly in the two directions, the required torque is smaller in this embodiment despite the higher toner feeding force.

From the standpoint of reducing the required torque and the increase of the toner feeding force, the width of the slit **15*b*3 in the main portion of the blade 15*b*1** has a width of approx. 0.5–3 mm. The interval between the slits is preferably approx. 20–60 mm, more preferably approx. 30–55 mm, and most preferably approx. 34–52 mm.

The length of the rectangular hole **15*b*4 in the longitudinal direction is preferably approx. 20–80% of the interval of the slits. It is preferable that the side thereof which is parallel with the stirring shaft 15*a* and adjacent to the shaft 15*a* is in contact with the stirring shaft 15*a***.

From the standpoint of reducing the toner remaining amount and reducing the required torque, the length of the end surface of the auxiliary portion **15*b*2 measured along the length of the rotational shaft is preferably approx. 5–15 mm longer than the width of the slit 15*b*3**.

A description will be made as to the distance of the stirring blades **15*b*1 and 15*b*2 in the radial direction. It is slightly longer than the internal radius of the container 12*a*, so that it is rotated with light contact with the inner wall of the container 12*a*. By doing so, the stirring blades 15*b*1 and 15*b*2 are rotated with small deformation, and when the deformation is removed by the elasticities of the blades 15*b*1 and 15*b*2 at the opening 12*a***, the toner is thrown, by which the toner supplying effect is increased.

Therefore, the distance from the rotational center of the stirring member 15 to the free end of the blade is longer by approx. 0.5–5 mm, preferably 1.0–4 mm, and more preferably 1.5–3 mm approximately than the inner radius of the container 12.

If the difference is smaller than 0.5 mm, then sufficient restoration force of the blade is not expected, and if it is larger than 3 mm, then toner feeding power is too large resulting in excessive toner being supplied into the developer chamber **5*a***, which may lead to caking of the toner. Additionally, the required rotational torque is large.

In this embodiment, as described hereinbefore, the stirring shaft **15*a* and the stirring blades 15*b* are separately manufactured, and are integrated by press-fitting. Preferably, however, the stirring shaft 15*a* and the stirring blade 15*b*** may be integrally formed through ejection molding or the like. By doing so, the number of parts and manufacturing steps can be reduced, and in addition, the accuracy of the dimension from the center to the free end of the blade can be improved.

In this case, a high speed and high pressure injection molder is preferably used since then the thick wall portion of the shaft and the thin wall portion of the blade can be simultaneously molded with high precision. In this integral molding type method, the ejection pressure is approx. 500–1500 kgf/cm$^2$, and the filling time of the resin material is preferably approx. 0.005–0.02 sec. Using these values, an integral stirring member 15 having an integral stirring shaft **15*a* and stirring blade 15*b* is injection-molded, and it has been found that any inconveniences such as waving or the like is not observed in the stirring blade 15*b***.

A more preferable manufacturing method is a gas assist injection molder. In this case, the stirring shaft **15*a* can be a hollow shaft, which is convenient from the standpoint of the straightness of the stirring shaft 15*a*. The cross-section is preferably circular in which two parts are removed in the hollow part. The removed part is effective as a seat for the mounting of the stirring blade 15*b***.

Cap

The cap 16 functions to plug the filling opening **13*b* in the flange 13, after the toner is filled in the container 12**. It is of low density polyethylene, high density polyethylene, polypropylene or the like (preferably low density polyethylene), and in the form of a cylinder having a bottom portion.

By press-fitting the cap 16 into the filling opening **13*b*, by which the filling opening 13*b*** is closed and sealed so that toner leakage is prevented.

Grip

Figure 6:
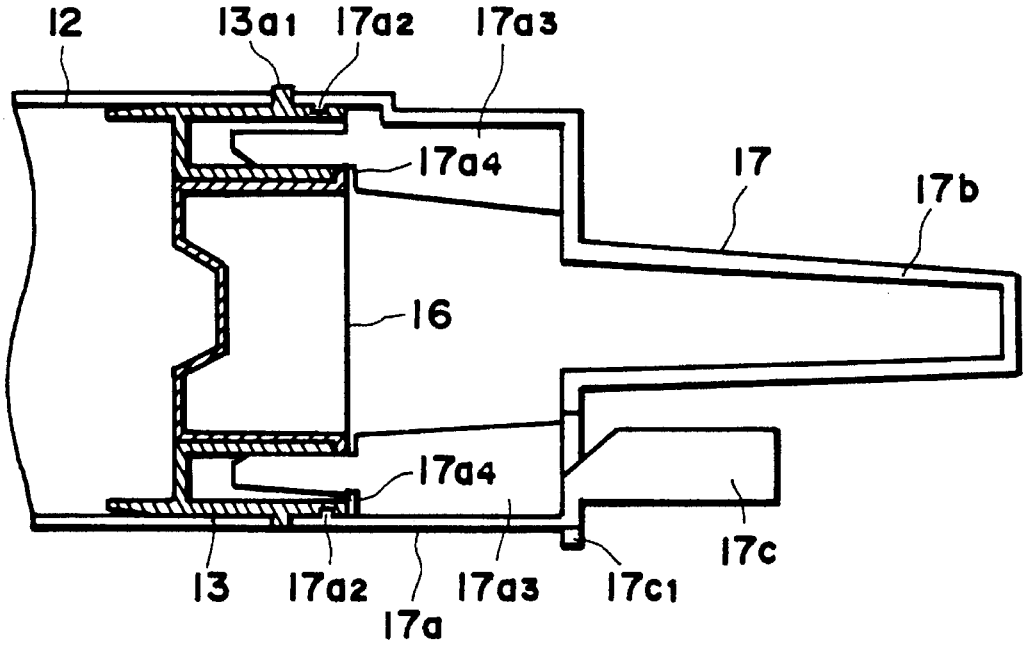
FIG. 6 is a sectional view of a part with a grip.

A description will be made as to the grip 17. It is effective to cover the cap 16 for the opening **13*b* after the filling of the toner into the container 12, and also to function as a grip when mounting or demounting the toner cartridge C, relative to the developing device 5. As shown in FIGS. 4 and 6, it has an integral movable lever 17*c* constituting locking means for preventing rotation of the engaging portion 17*a*, grip 17*b* and the toner cartridge C. As the material for the grip 17, polypropylene (PP), acrylonitrile styrenebutadiene copolymer (ABS) or anti-impact polystyrene (HIPS) or another thermoplastic material may be used. Polypropylene is most preferable since the movable lever 17***c* using elasticity is provided.

The engaging portion 17*a* functions to engage the grip 17 in the flange 13. It is in the form of a cylinder, and at an end thereof, a cut-away portion 17*a*1 is formed corresponding to the projection 13*a*1 or 13*a*2 of the flange 13. At several positions of the internal surface (equidistant three portions in this embodiment), engaging claws 17*a*2 are provided. By engaging the cut-away portion 17*a*1 with the projections 13*a*1 and 13*a*2, by which the positioning is accomplished. It is firmly locked into a recess 13*e* in the outer surface of the flange 13, by which the grip 17 is fixed to the flange 13.

The inside surface of the engaging portion 17*a* is provided with several ribs 17*a*3 (four ribs are preferable). The internal diameter between ends of the ribs is substantially equal to the outer diameter of the cap 16. When the grip 17 is engaged with the flange 13, the internal diameter portions of the ribs confine the outer peripheral surface of the cap 16. At a predetermined position of the rib 17*a*3, a stepped portion 17*a*4 is formed, at a position for confining an end of the cap 16 when the grip 17 is engaged with the flange 13, as shown in FIG. 6.

By doing so, when the grip 17 is engaged with the flange 13, the cap 16 is completely hidden, and in addition, it is confined by the rib 17*a*3, so that disengagement of the cap 16 from the opening 13*b* is completely avoided.

As a method of mounting the grip 17 to the flange 13, the above-described clamping method is not limiting, but hot melt bonding, ultrasonic wave fusing, press-fitting, adhesive tape or the like are usable. However, the above-described clamping method is preferable since it is easy. When this is used, a disengageable structure is provided.

The movable lever 17*c* is vertically movable by the elasticity of the engaging portion 17*a* with a slit in the engaging portion 17*a*. At a predetermined position, a locking projection 17*c*1 is formed. The projection 17*c*1 is locked at a predetermined position of the developing device 5 when the toner cartridge C is mounted on the developing device 5 with the rotation, so that the rotation of the toner cartridge C is prevented during image forming operation.

Toner Cartridge Manufacturing Method

A description will be made as to the process of assembling the toner cartridge C, using the above-described members.

As described, the sheet 12*c* is mounted to the opening 12*a* of the container 12 to plug the opening 12*a*, and a hot melt bonding material is applied on the internal surface of the container 12 at the opposite end portions. The projections 13*a*1, 13*a*2, 14*a*1 and 14*a*2 of the flanges 13 and 14 are aligned with the cut-away portions 12*b* of the container 12. The flanges 13 and 14 are engaged and bonded at the opposite ends of the toner replenishing container 12.

Then, a stirring member 15 comprising the stirring shaft 15*a* and the stirring blades 15*b* mounted thereon is inserted into the bore 14*b* of the flange 14 to mount it to the container 12. Since the stirring blades 15*b* are flexible and thin, and since the length between the end of the main blade portion 15*b*1 and the auxiliary blade portion 15*b*2 is larger than the diameter of the bore 14*b*, the insertion is not easy.

Figure 7A:
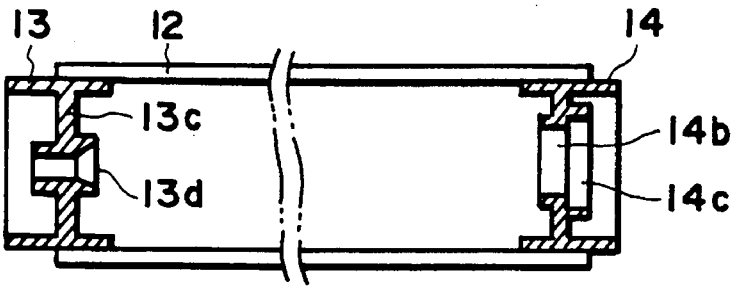
FIGS. 7A and 7B illustrate the mounting of the stirring member to a toner replenishing container.
Figure 7B:
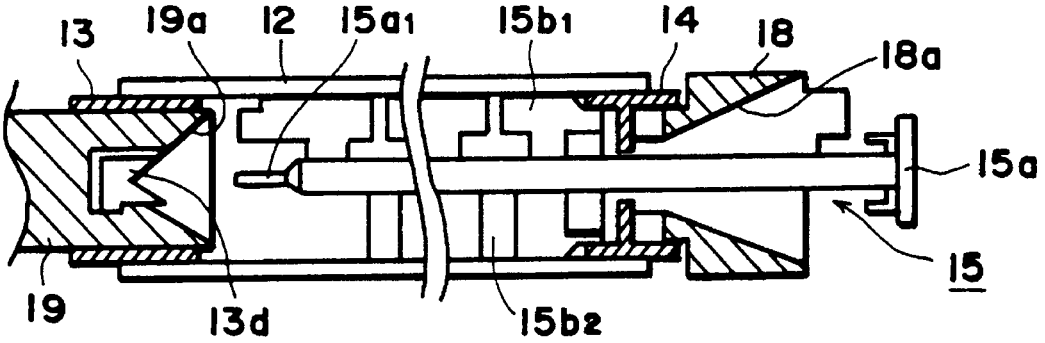

As shown in FIG. 7B, a tool 18 is mounted to the flange 14. The tool has a bore 18*a* in the form of a funnel having gradually and continuously decreasing diameter. The small diameter portion of the funnel bore 18*a* has the same size as the bore 14*b* of the flange 14. When the tool 18 is mounted to the flange 14, the small diameter portion and the bore 14*b* are continuous. Therefore, when the stirring member 51 is inserted into the funnel bore 18*a* of the tool 18, the blades 15*b*1 and 15*b*2 are deformed along the surface of the funnel bore 18*a*, and therefore, they are smoothly inserted into the bore 14*b* of the flange while being along the bore surface.

In this manner, the stirring member 15 is inserted into the container 12, and the engaging portion 15*a*1 at the end of the stirring member 15 is engaged into the shaft bore 13*d* of the flange 13. In order to make the insertion easy at this time, a tool 19 is mounted to the flange 13, as shown in FIG. 7B.

The tool 15 has a diameter permitting insertion into the filling opening 13*b* of the flange 13, and is provided with a cross groove (not shown) to avoid interference with the cloth rib 13*c* of the filling opening 13*b*. An end of the tool 19 is provided with a hole 19*a*, and has a larger diameter at the end. The diameter gradually decreases, and the smallest diameter portion is continuous with the hole 13*d*. Therefore, the engaging portion 15*a*1 of the end of the stirring member inserted from the flange 14 of the container 12 is guided by the funnel bore 19*a* and is smoothly brought into engagement with the shaft bore 13*d*.

After the engaging portion 15*a*1 is inserted into the shaft bore 13*d* as described above, the stirring member 15 is pushed strongly, by which the wing rib 15*a*3 of the gear 15*a*2 (FIG. 4) is engaged with the claw 14*d* of the flange 14 and clamping therebetween is established to prevent movement along the shaft. In addition, the outer periphery of the gear 15*a*2 is supported on the ring jaw 14*c* (FIG. 4) of the flange 14 to prevent movement in the radial direction. Therefore, the stirring member 15 is supported by the flanges 13 and 14 without play. Upon the mounting of the stirring member 15, a sealing member for preventing toner leakage is preferably mounted between them to prevent leakage of toner between the bore 14*b* of the flange 14 and the gear portion 15*a*2 of the stirring member 15.

Figure 8:
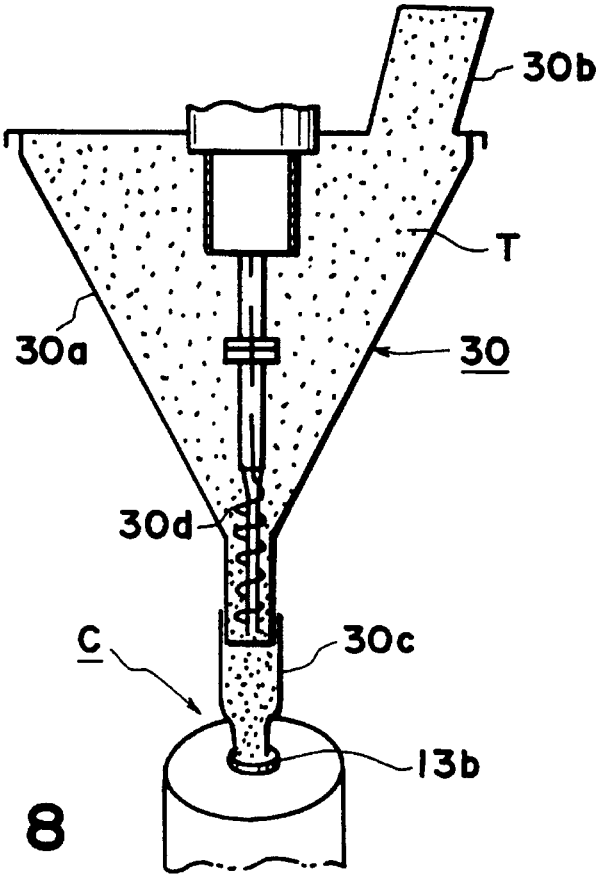
FIG. 8 illustrates toner filling.

Then, the tools 18 and 19 are removed. The toner is filled through the opening 13*b*. As shown in FIG. 8, the toner (one component magnetic toner in this embodiment) T is filled using developer hopper 30. The developer hopper 30 is provided with a supply port 30*b* for permitting supply of the toner T, at an upper portion of the funnel-like main body 30*a*. At the bottom end, an adopter 30*c* for fitting with the port 13*b* of the toner cartridge C is mounted. Inside the main body 30*a*, there is an auger 30*d* which is rotatable. By properly controlling the rotation of the auger 30*d*, the toner filling speed can be controlled. The inside surface of the main body 30*a* is treated with fluorine to reduce the frictional coefficient, by which the toner filling efficiency from the developer hopper 30 to the toner cartridge C is improved. After the toner T is supplied in this manner, a cap 16 is press-fitted to the opening 13*b*, thus plugging the opening 13*b*.

Subsequently, the projections 13*a*1 and 13*a*2 of the flange 13 are aligned with the cut-away portion 17*a*1 of the grip 17, and the engaging portion 17*a* of the grip 17 is press-fitted into the flange 13, by which an engaging claw 17*a*2 of the engaging portion 17 is locked in a locking recess 13*e* of the flange 13 so that they are securely clamped. By doing so, the cap 16 is completely hidden, and the cap 16 is fixed by the rib 17*a*3 (FIG. 6).

In the manner described above, the toner cartridge C shown in FIG. 3 is assembled.

Mounting of the Toner Cartridge to a Developing Apparatus

Figure 9:
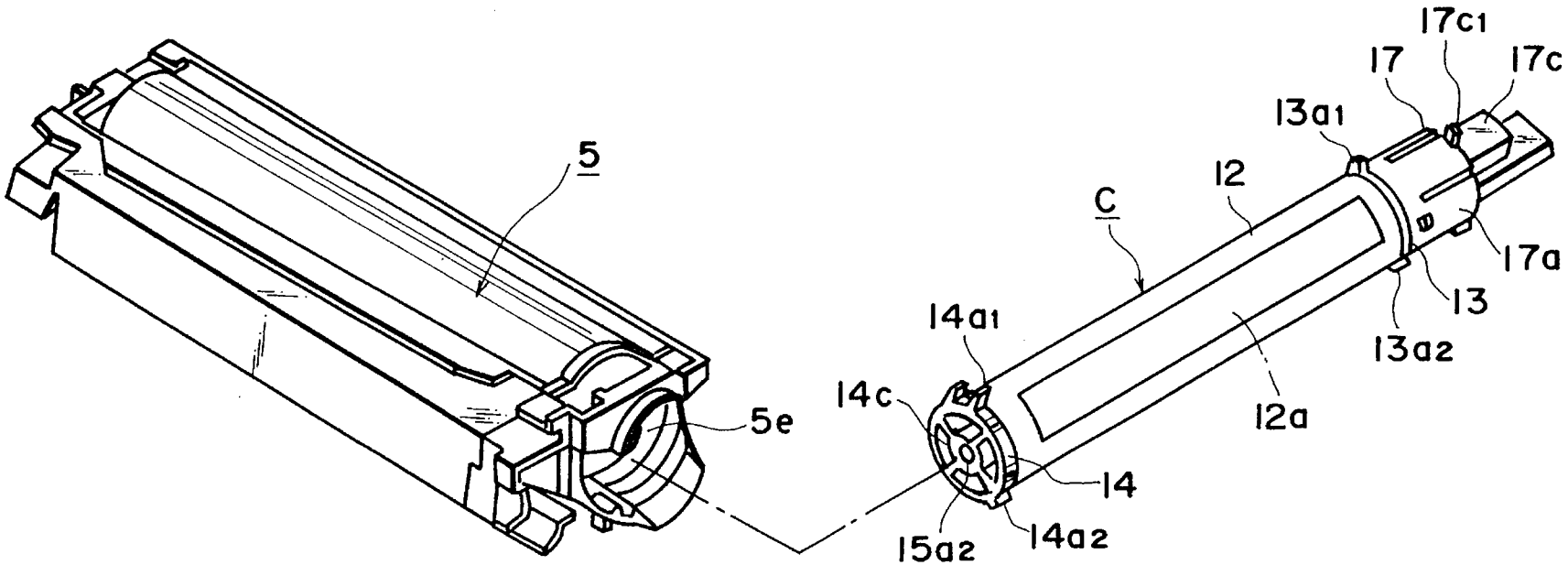
FIG. 9 is a perspective view of a developing apparatus and toner cartridge.

The toner cartridge C is inserted into a cartridge mount 5*e* of the developing apparatus 5, as shown in FIG. 9. The developing device 5, as shown in FIG. 2, is provided with a cartridge mount 5*e* for receiving the toner cartridge C adjacent the developer chamber 5*a*. The mount 5*e* and the developer chamber 5*a* are in communication with each other through an opening 5*f*. The communicating portion is provided with a shutter 20 for closing and shutting the opening 5*f*. The shutter 20 rotates with mounting and demounting of the toner cartridge C.

A description will be made as to the structure of the shutter 20 and the mounting process of the toner cartridge.

Shutter

Figure 10A:
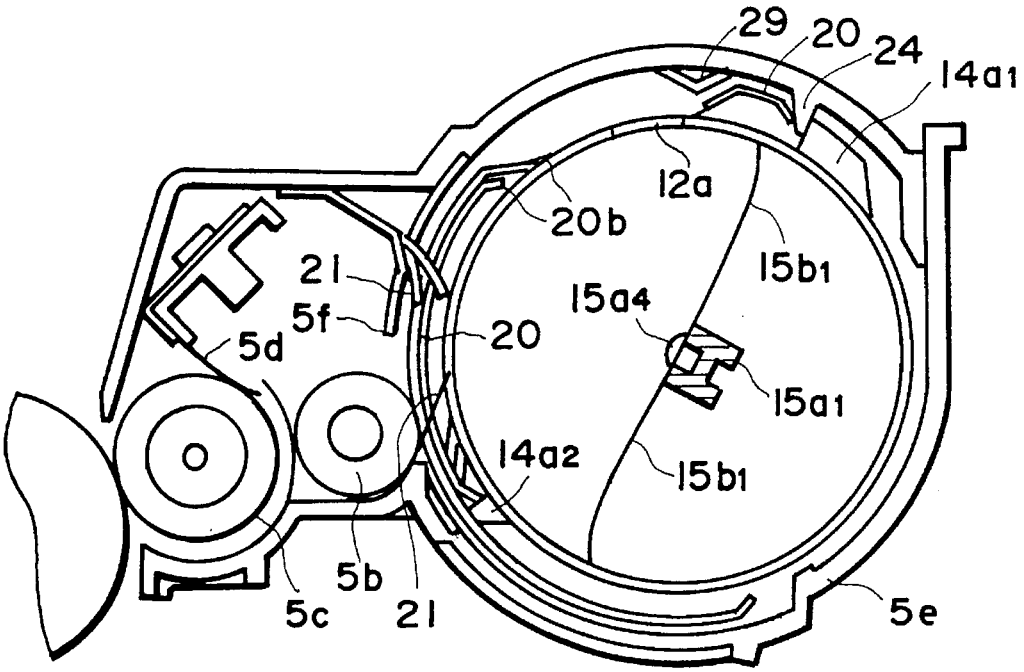
FIG. 10A illustrates a toner cartridge when it is inserted into a cartridge mount.

When the toner cartridge C is not mounted on the mount 5*e* or when the toner cartridge C shown in FIG. 10A is in a mounting or demounting position (pose) with the opening 12*a* at an upper position, the shutter member 20 closes the opening 5*f* to permit reverse flow of the toner from the developer chamber 5*a* to the mount 5*e*. With this closing position, the shutter 20 is confined by a spring 29 mounted to the inner top surface of the cartridge mount 5*e*, so that it is not removed. With this state, the shutter member 20 is sandwiched between projections 14*a*1 and 14*a*2.

Figure 10B:
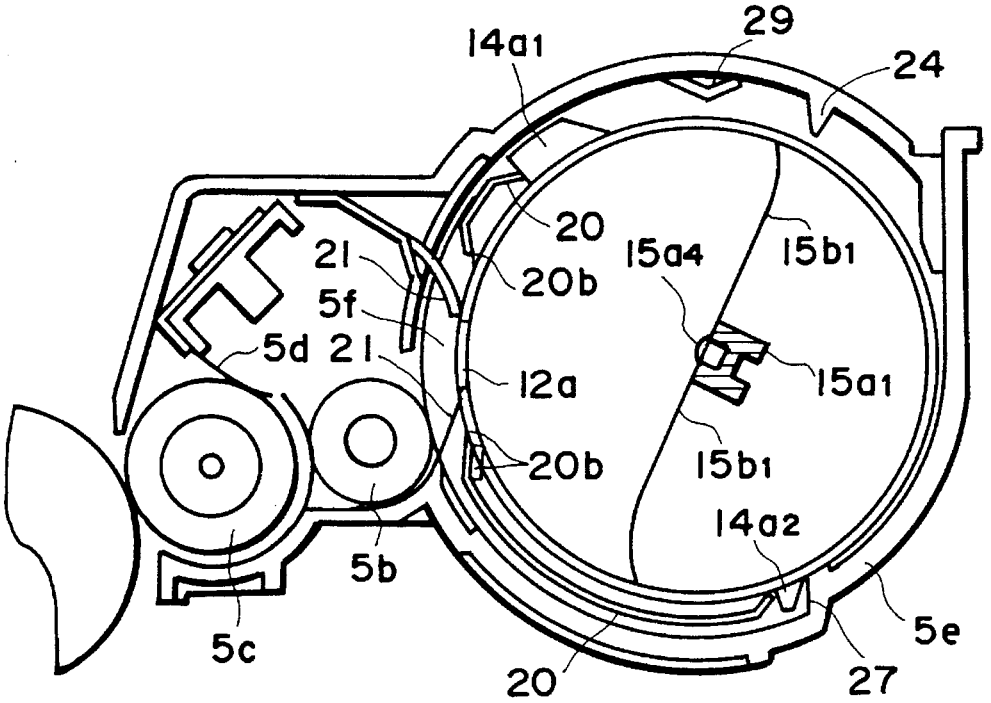
FIG. 10B illustrates a toner cartridge when it is rotated to a usable state.

When the toner cartridge C is rotated from the mounting and demounting position to the using position, the shutter 20 is urged by a projection 14*a*1 and therefore is rotated to open the opening 5*f*, as shown in FIG. 10B, to permit toner supply from the toner cartridge C into the developer chamber 5*a*.

Figure 11:
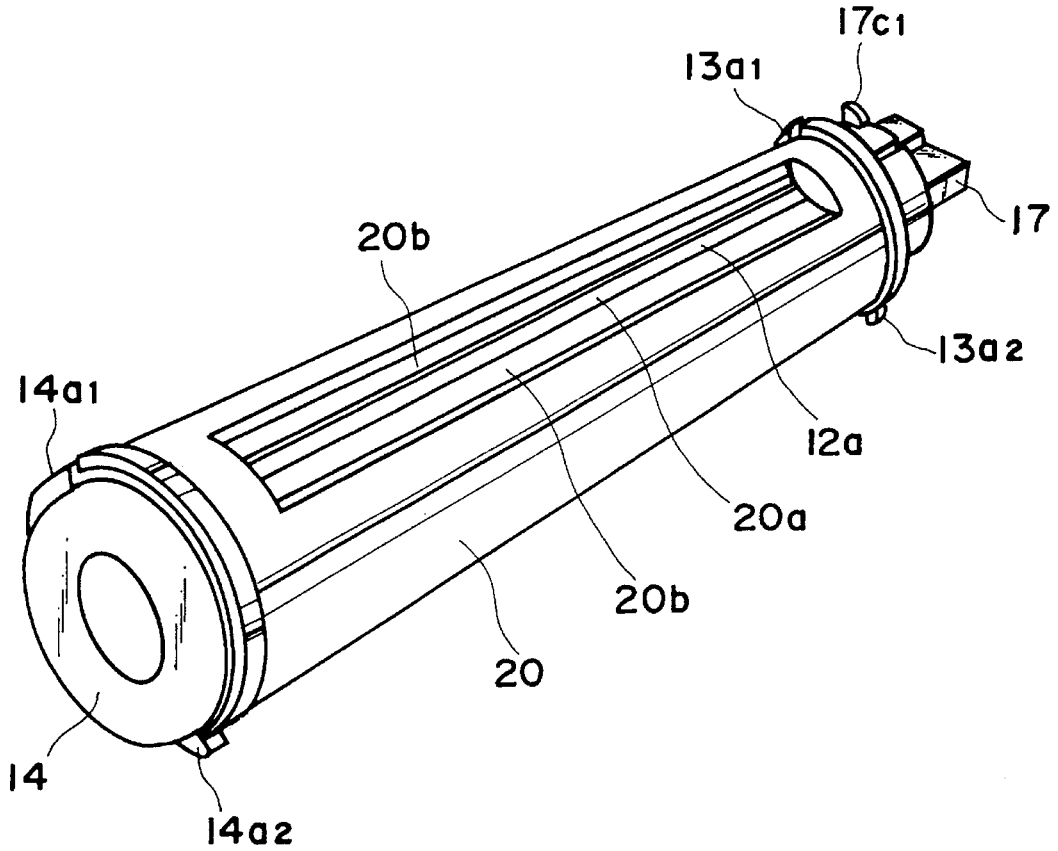
FIG. 11 illustrates engaged state between a projection of the toner cartridge and a shutter.

FIG. 11 shows a relation between the toner cartridge C and the shutter 20. The shutter 20, as shown in FIG. 11, is provided with an opening 20*a* in a semi-cylindrical surface along the periphery of the container 12. The configuration and size of the opening 20*a* are generally the same as the opening 12*a* of the container 12, or the opening 20*a* of the shutter member 20 is slightly larger. The shutter member 20 is an SUS or the like plate stamped out and bent. Around the internal surface of the opening 20*a*, a sealing member 20*b* is mounted to prevent toner leakage (FIG. 10). The sealing member 20*b* is preferably elastic material such as polyester, polyurethane foamed material or the like. When the toner cartridge C is inserted into the mount 5*e*, the seal 20*b* is contacted to the outer surface of the toner cartridge C to prevent the leakage of toner between the shutter 20 and the toner cartridge C. As shown in FIG. 10, a similar seal 21 is provided between the periphery of the opening 5*f* of the developer chamber 5*a* and the shutter 20, thus preventing toner leakage therebetween.

Toner Cartridge Mounting Process

Figure 12A:
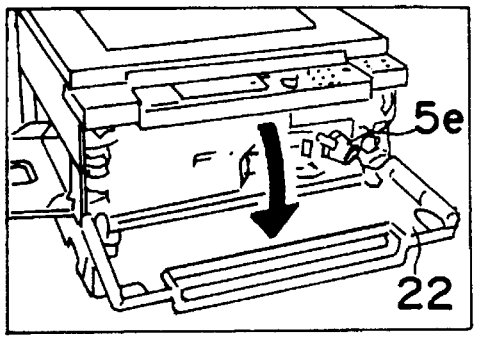
FIGS. 12A to 12F illustrate a toner cartridge mounting process.
Figure 12D:
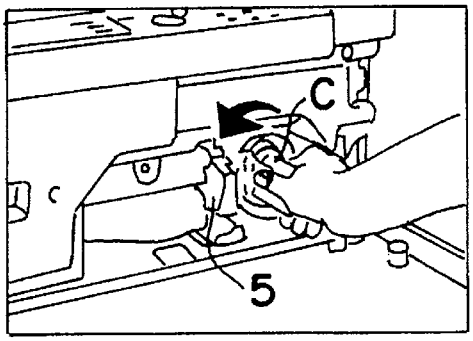
Figure 12B:
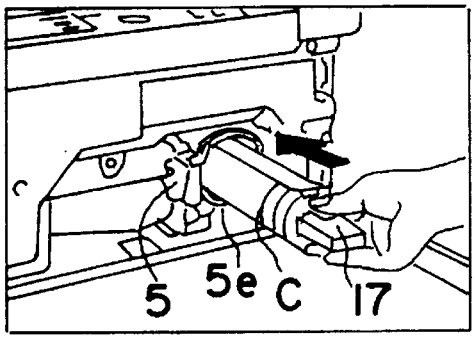
Figure 12E:
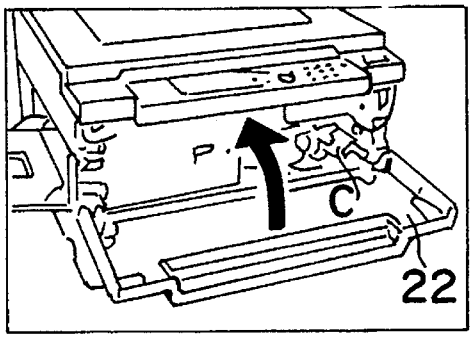
Figure 12C:
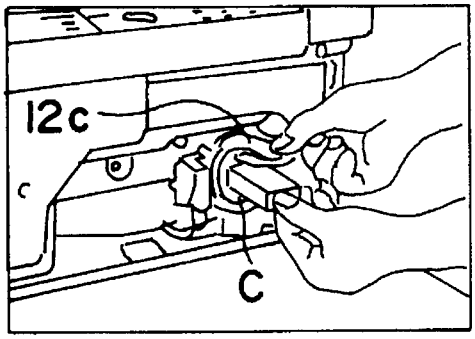
Figure 12F:
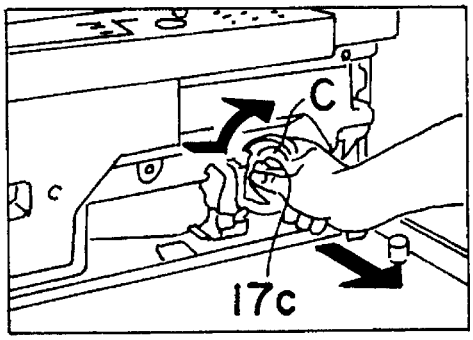

Description will be made as to the process of an operator mounting the toner cartridge C to the developing device 5. Referring to FIGS. 12A to 12F, a side cover 22 of a copying machine is opened (FIG. 12A), and the used-up toner cartridge C is removed. Thereafter, a fresh toner cartridge C is mounted to the cartridge mount 5*e* of the developing device 5 with the toner discharging opening 12*c* facing upward (FIG. 12B). Subsequently, the sealing member 12*c* for the opening 12*a* is removed (FIG. 12C), and the toner cartridge C is rotated about 90 degrees to bring the opening 12*a* into alignment with the opening 5*f* of the developing device 5 (FIG. 12D). At this time, the toner cartridge C is locked so as not to be rotated with the stirring member 15. Then, the side cover 22 is closed, so that the mounting of the toner cartridge C is completed (FIG. 12E).

When the toner cartridge C is removed, the lever 17*e* is operated to release the locking (FIG. 12F), and the reverse operation is carried out to remove it from the developing device 5.

In accordance with the above-described process, the functions of various parts when the operator mounts the toner cartridge C onto the developing device 5, will be described.

Figures 13A, 13B:
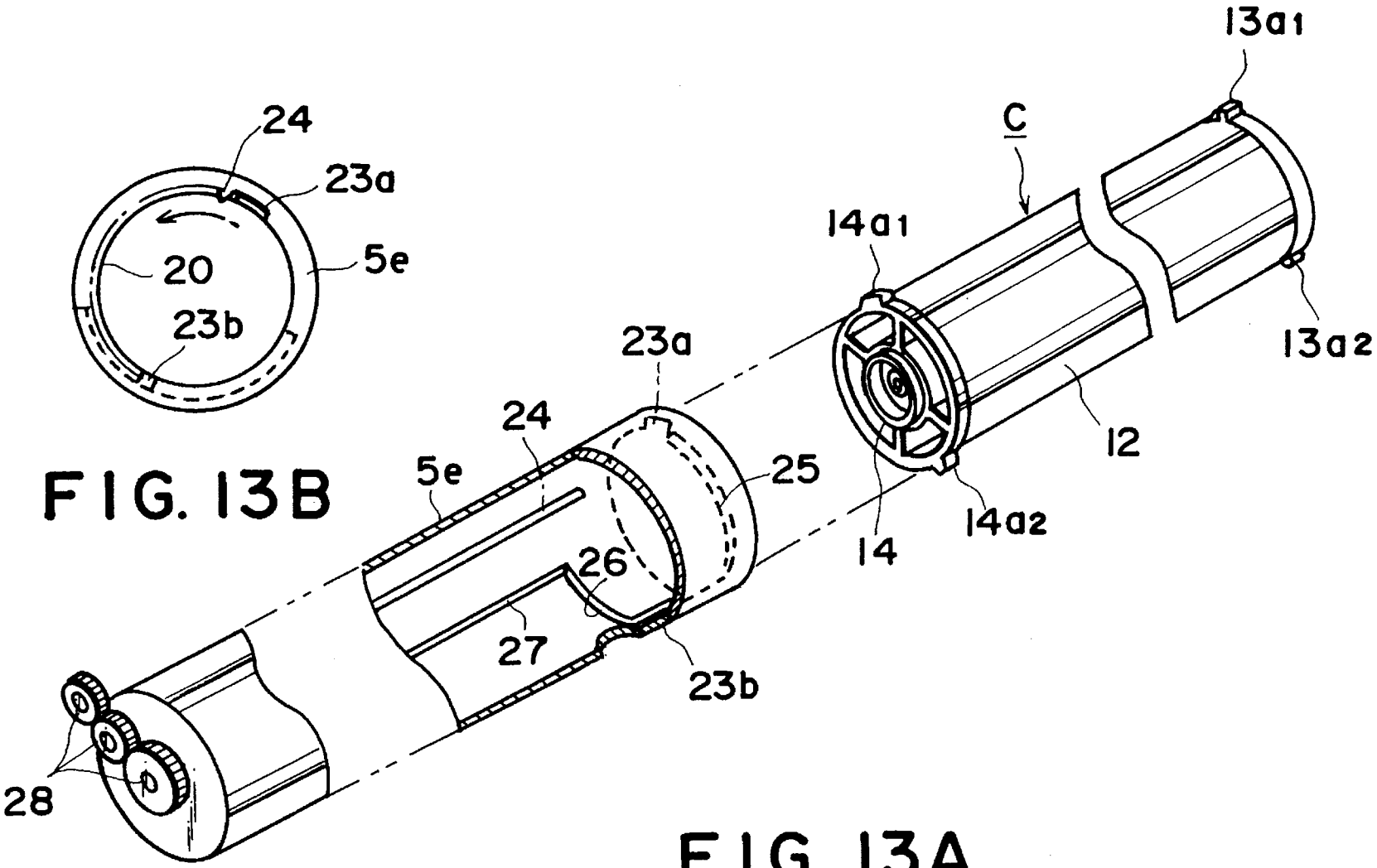
FIGS. 13A and 13B show a relation between a toner cartridge and a toner cartridge mount.

When the toner cartridge C is inserted into the cartridge mount 5*e*, two grooves 23*a* and 23*c* are formed at positions corresponding to the projections 14*a*1 and 14*a*2 of the flange 14, as shown in FIGS. 13*a* and 13*b*, and therefore, insertion of the toner cartridge C is prevented unless they are aligned. The flange 13 is provided with projections 13*a*1 and 13*a*2. However, the angular positions thereof are aligned with the projections 14*a*1 and 14*a*2, and the corresponding projections 13*a*1 and 13*a*2 are of the same configurations, or the projections 13*a*1 and 13*a*2 a smaller, and therefore, the flange projections 13*a*1 and 13*a*2 are automatically insertable into the grooves 23*a* and 23*b*. By making the configurations of the grooves 23*a* and the projections 14*a*1 different depending on the kinds of the toner cartridge C (the developing device used is different depending on the material of the toner), by which erroneous mounting of the toner cartridge C can be prevented.

The flange projections 14*a*1 and 14*a*2 have different sizes, and they are not diametrically opposite, and therefore, the insertion angle of the toner cartridge C is limited to one. Upon insertion of the toner cartridge C, the opening 12*a* is controlled to face upward, by which toner scattering upon mounting or demounting the toner cartridge C is prevented. When the used-up toner cartridge C is removed, the small amount of toner remaining therein may scatter, but this is effectively prevented.

As shown in FIG. 13A, the inside surface of the cartridge mount 5*e* is provided with a guiding rail 24 parallel with the inserting direction of the cartridge, along which the flange projection 14*a*1 is guided. Therefore, when the operator does not insert the toner cartridge C to a predetermined position, rotation of the toner cartridge C in the mounting direction (arrow in FIG. 13B) is not permitted. The guide rail 24, as shown in FIG. 13A, stops at a rear portion and the inlet portion of the cartridge mount 5*e*, and therefore, when the toner cartridge C is sufficiently inserted to a predetermined position, the flange projection 13*a*1 is out of alignment with the guide rail 24, and the projection 13*a*2 of the flange 13 is also out of alignment with the groove 23*b*, so that rotation of the cartridge C in the mounting direction is permitted.

Figure 14A:
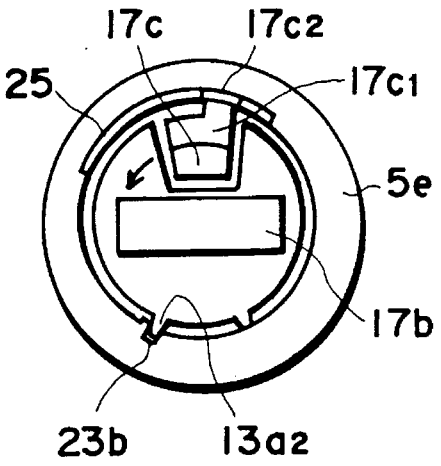
FIG. 14A illustrates a toner cartridge when it is inserted to a cartridge mount.

At an insertion end of the cartridge of the cartridge mount 5*e*, as shown in FIG. 13A, a jaw 25 is formed. When the operator inserts the toner cartridge C sufficiently in the cartridge mount 5*e*, as shown in FIG. 14A, the lever 17*c* deforms by elasticity, by which a locking projection 17*c*1 goes beyond the jaw 25. By this, even when the operator peels the sealing member 12*c* covering the opening 12*a*, at the end 12*c*1, the locking projection 17*c*1 is engaged with the jaw 25, and therefore, the toner cartridge C is prevented from being removed from the cartridge mount 5*e* together with the sealing member 12*c*.

When the toner cartridge C is completely inserted, the opening 12*a* and the shutter opening 20*a* are in communication with each other as shown in FIG. 11, and the flange projections 13*a*1, 13*a*2, 14*a*1 and 14*a*2 are engaged with the end portions of the shutter member 20 with the four corners of the shutter 20 being sandwiched thereby. By doing so, the shutter member is integrally rotatable with the rotation of the toner cartridge C.

Then, the sealing member 12*c* of the opening 12*a* is peeled off. At this time, since the toner cartridge C is completely accommodated by the cartridge 5*e*, toner scattering or leaking can be prevented. Particularly in order to avoid the non-uniform distribution of the toner in the longitudinal direction of the toner cartridge, the toner cartridge is shaked or rolled conventionally. In such a case wherein the toner powder in the container 12 contains a sufficient quantity of air so that the apparent density of the toner is low, and the flowability of the toner is high, the toner scattering effect is remarkably advantageous.

After the toner cartridge C is opened by peeling the sealing member 12*c* off, the operator then rotates the toner cartridge C to direct the toner discharging opening 12*a* in a predetermined direction. In this embodiment, the opening 5*f* of the developing device 5 is at a lateral portion of the toner cartridge C, and therefore, the opening 12*a* is directed substantially horizontally. Since the shutter 20 is sandwiched by the flange projections 13*a*1, 13*a*2, 14*a*1 and 14*a*2 of the toner cartridge C, as described above, when the toner cartridge C is rotated with the grip 17*b*, the shutter 20 is integrally rotated. At this time, close contact is maintained between the outer peripheral surface of the toner cartridge C and the shutter member 20 and between the developer chamber 5*a* and the shutter 20, by the sealing members 20*b* and 21.

When the toner cartridge C is rotated, the projection 13*a*2 of the flange 13 is engaged to a stepped portion 26 of the cartridge mount 5*e*, as shown in FIG. 13A, and therefore, even if an attempt is made to remove the toner cartridge C halfway through the rotation, the projection 13*a*2 is confined by the step 26, so that removal is not permitted.

A description will be made as to the relationship between the flange projection of the toner cartridge and the toner discharging opening 12*a* in this embodiment. If the flange projection is at any position away from a longitudinal extension of the toner discharging opening 12*a*, then rotation of the shutter 20 is permitted irrespective of whether it is provided on only one of the flanges 13 and 14. However, at least one flange projection is provided at each longitudinal end of the toner cartridge C since then the force relating to the opening or closing of the shutter 20 is distributed uniformly to the opposite ends of the shutter member 20 and the toner cartridge C, by which deformation of the toner cartridge C is prevented to permit a smooth opening or closing motion of the shutter 20. In addition, projections 13*a*1 and 14*a*1 for moving the shutter 20 to open the opening 5*f* by engagement of the side surface with the shutter 20, and projections 13*a*2 and 14*a*2 for moving the shutter 20 to close the opening 5*f*, are separate portions from each other, and therefore, the load applied to the projection can be reduced.

In addition, as in this embodiment, two projections 13*a*1, 13*a*2, 14*a*1 and 14*a*2 for the opening and closing functions, respectively, are disposed at opposite positions with an extension of the opening 12*a* therebetween, at the longitudinal ends of the cartridge C. This is preferable. Particularly, the shutter 20 is sandwiched by the opening projections 13*a*1 and 14*a*1 and the closing projections 13*a*2 and 14*a*2.

The projections 13*a*1, 13*a*2, 14*a*1 and 14*a*2 may be fused or bonded on the toner replenishing container 12, or they may be integrally molded with the container 12. However, from the standpoint of the strength and the cost, they are preferably integrally molded on the flanges 13 and 14.

The ends, adjacent to the toner discharging opening 12*a*, of the flange projections 13*a*1, 13*a*2, 14*a*1 and 14*a*2, are engaged with the shutter 20 so that they receive the largest force upon the shutter opening and closing. For this reason, the component in the direction away from the center of the cylinder of the container 12 and the component toward the center, are as small as possible. Therefore, the ends, adjacent to the toner discharging opening 12*a*, of the flange projections 13*a*1, 13*a*2, 14*a*1 and 14*a*2, are substantially perpendicular to the outer peripheral tangent line of the cylinder at the portion.

The heights of the projections 13*a*1, 13*a*2, 14*a*1 and 14*a*2 are preferably such that each is projected beyond the outer surface of the container 12 by approx. 2–10 mm to ensure engagement with the shutter 20 and to permit opening and closing motion of the shutter 20. The projection is further preferably 4–6 mm. If it is smaller than 2 mm, the degree of engagement is too small with the possible result that the engaging portion of the shutter 20 rides on the projections 13*a*1, 13*a*2, 14*a*1 and 14*a*2 upon the opening or closing of the shutter 20. If it is larger than 10 mm, the cartridge mount 5*e* becomes bulky.

Figure 15A:
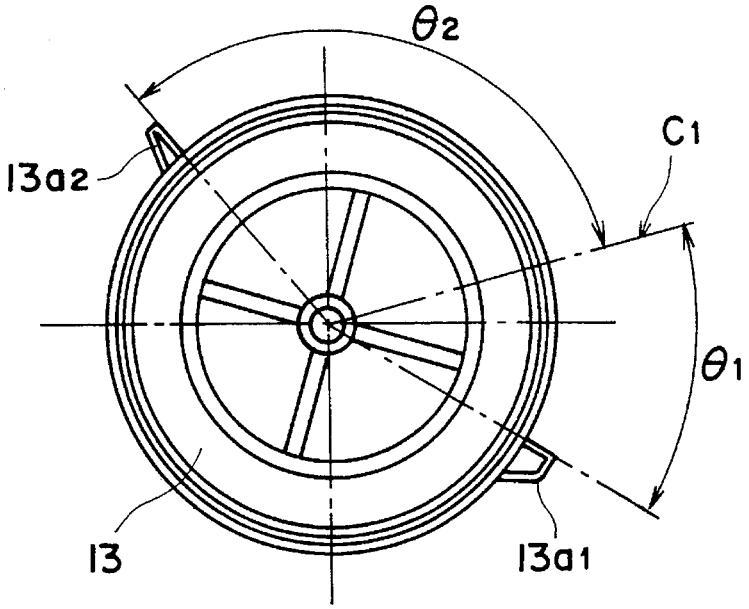
FIGS. 15A and 15B show a positional relation between a toner discharge opening and a flange projection.
Figure 15B:
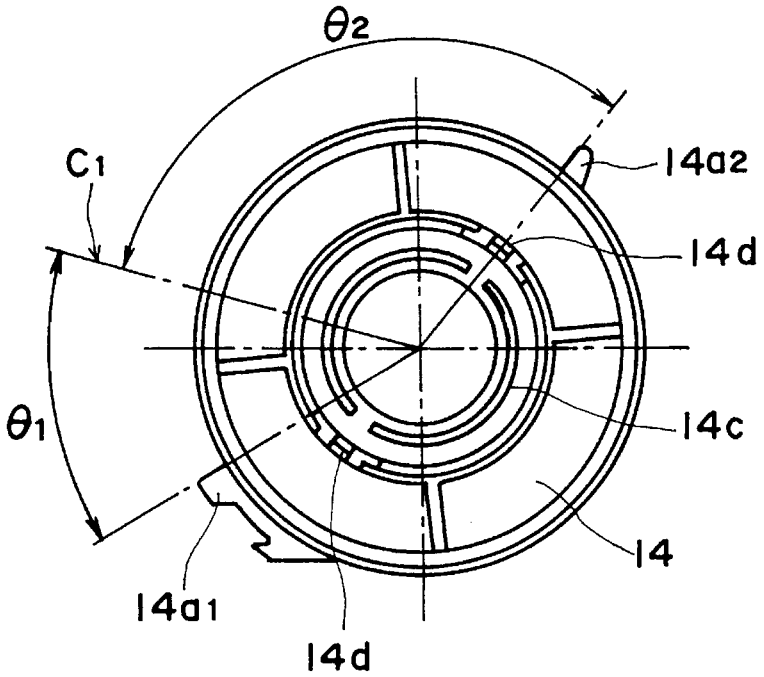

The positional relationship between the toner discharging opening 12*a* and the projections 13*a*1 and 13*a*2 (first projections) and projections 14*a*1 and 14*a*2 (second projections) with the opening 12*a* therebetween, will be described as to the circumferential direction. As shown in FIGS. 15A and 15B, an angle formed between a line connecting the center of the cylinder of the container 12 and the center C1 in the longitudinal direction of the toner discharging opening 12*a* and a line connecting the center of the cylinder and an end of the projections 13*a*1 and 14*a*1 adjacent to the toner discharging opening, is θ1, and an angle formed between a line connecting the center of the cylinder and the longitudinal center C1 of the toner discharging opening 12*a* and the ends of the projections 13*a*2 and 14*a*2 adjacent to the toner discharging opening and the center of the cylinder, is θ2. The angle θ1 is preferably approx. 20–90 degrees, more preferably approx. 30–50 degrees, and most preferably approx. 40–50 degrees. The angle θ2 is preferably approx. 70–160 degrees, most preferably 105–130 degrees, and most preferably approx. 110–120 degrees. In this embodiment, the angle θ1 is 45±1 degrees, and θ2 is 115±1 degrees.

If the angle θ1 is smaller than 20 degrees and θ2 is smaller than 70 degrees, the projections 13*a*1, 13*a*2, 14*a*1 and 14*a*2 are close to the opening 12*a* of the less rigid toner container 12, and therefore, the toner discharge opening 12*a* is easily deformed during the opening and closing operation of the shutter. In addition, the space for the seal 20*b* is limited. If the angle θ1 is larger than 90 degrees, or θ2 is larger than 160 degrees, the circumferential length of the shutter 20 becomes long, resulting in a larger operational force being required for the opening and closing of the shutter 20.

In this embodiment, as described hereinbefore, shutter opening projections 13*a*1 and 14*a*1 and shutter closing projections 13*a*2 and 14*a*2 are provided at the longitudinally opposite ends of the toner replenishing container 12. If the projection is provided at only one longitudinal end of the container 12, the positions of the projections faced to each other with the toner discharging opening 12*a* therebetween are such that the line connecting the center of the cylinder and the longitudinal center of the opening 12*a* and the line connecting the center of the cylinder and the projection side end adjacent the toner discharging opening 12*a* form an angle between approx. 20–160 degrees, for the reasons described in the foregoing.

When the toner cartridge inserted into the cartridge mount 5*e* is rotated in the mounting direction, the flange projections 13*a*1 and 14*a*1 for the shutter closing are engaged with the shutter 20 so that the cartridge C and the shutter 20 are integrally rotated. This rotation is limited upon the flange projections 13*a*2 and 14*a*2 being abutted to the step 27 of the cartridge mount 5*e*, as shown in FIG. 13A. At this time, the opening 12*a* of the container 12 and the opening 20*a* of the shutter 20 are directed substantially horizontally so that it is in communication with the opening 5*f* of the developing device 5 (FIG. 10B).

Figure 14B:
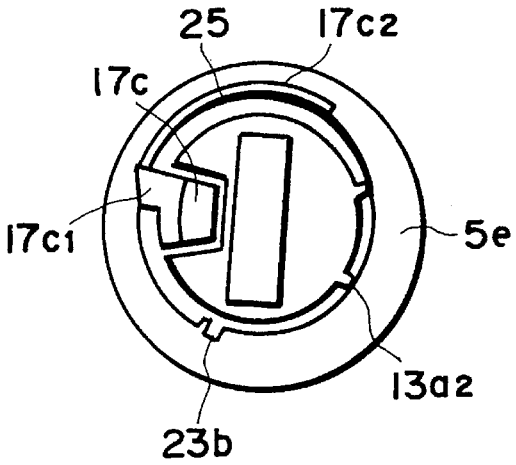
FIGS. 14B and 14C illustrate a toner cartridge when it is locked at a mounting position.
Figure 14C:
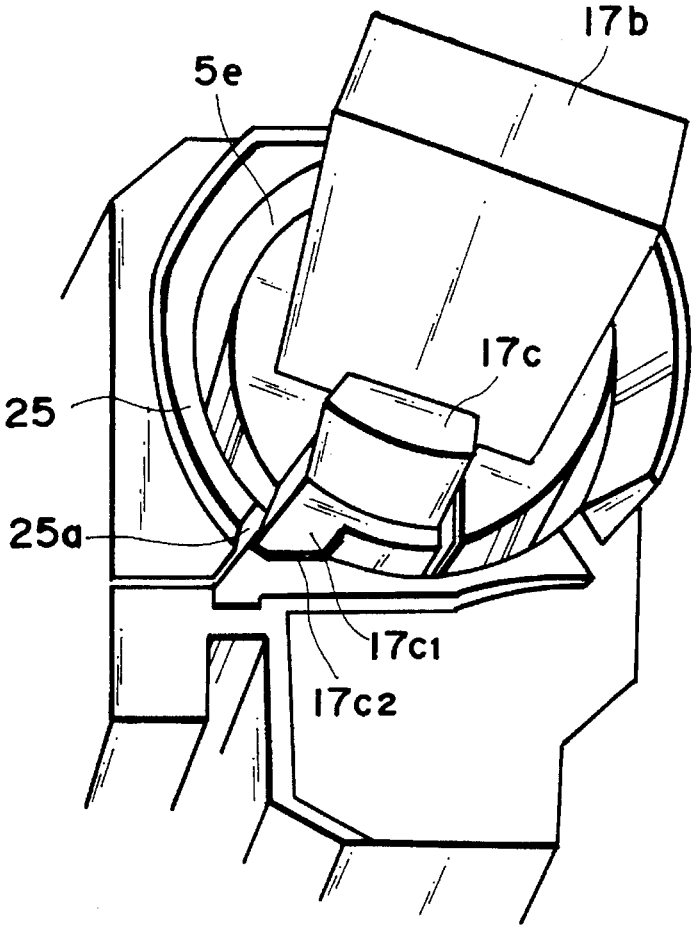

When the toner container 12 is rotated to the stop position in this manner, the movable lever 17*c* is elastically deformed as shown in FIGS. 14B and 14C, so that the locking projection 17*c*1 goes over the end 25*a* of the jaw 25 of the cartridge 5*a* to automatically engage the end. By doing so, even if the cartridge C is rotated in the clockwise direction, the rotation is prevented because of the engagement between the projection 17*c*1 and the jaw end.

In order to promote the motion of the projection 17*c*1 beyond the end 25*a* when the cartridge C is rotated in the mounting direction, an inclined surface 17*c*2 is formed. Therefore, even if the lever 17*c* is not pressed, when the cartridge C is rotated in the mounting direction, the locking projection 17*c*1 is abutted to the end 25*a* of the jaw, and the lever 17*c* elastically deforms along the inclined surface 17*c*2, so that the locking projection 17*c*1 goes beyond the end 25*a*. After this, the movable lever 17*c* elastically deforms resulting in an automatically locking operation. By this click, the operator can sense the assured mounting of the toner cartridge C.

By the mounting of the toner cartridge C, the gear 15*a*2 of the stirring member 15 is engaged with a driving gear 28 of the main assembly to permit rotation, as shown in FIG. 13A.

Toner Feeding Operation

In the manner described above, the toner cartridge C is mounted to the developing device 5 to permit an image forming operation. A description will be made as to the toner feeding operation from the toner cartridge C during the image forming operation.

During the image forming operation, a driving force is transmitted to the stirring member 15, and the member 15 rotates in the clockwise direction in FIG. 10B at 10.2 rpm, for example. In this manner toner in the toner replenishing container 12 is sufficiently stirred and made uniform by the stirring blade 15*b*, and in addition, it is properly electrically charged. The toner is fed to the developer chamber 5*a* of the developing device 5 through the toner discharge opening 12*a*, the shutter opening 20*a* and the opening 5*f* of the developing device. At this time, the toner discharge opening 12*a* is directed substantially horizontally, and therefore, a large amount of unstirred or uncharged toner is prevented from being supplied into the developing device 5 at once. With the reduction of the toner in the toner replenishing container 12 as a result of developing operation, the toner feeding force by the stirring member 15 is sufficiently strong, and therefore, the amount of toner in the developer chamber 5*a* is maintained at a constant level.

This is because the stirring blades 15*b* are made of elastic material, and the rotational radius thereof is slightly longer than the radius of the cylinder of the toner container so that the ends thereof are slightly extended out of the toner discharging opening 12*a*. More particularly, the blade 15*b* is slightly deformed with the friction with the internal wall surface of the container 12, but at the toner discharging opening 12*a*, it is elastically restored to throw the toner into the developing device 5. The elastic throwing of the toner is not strong when the amount of toner in the container 12 is large because the existence of the large amount of the toner functions as resistance, and therefore, toner agglomeration as a result of an excessive amount of toner in the developing device 5 and improper image formation attributable to the agglomeration, can be prevented. In addition, since the stirring rod 15*b* is deformed, an increase in the required torque is prevented. On the other hand, in accordance with the reduction of the amount of toner in the container 12, the restoring action of the blade 15*b* becomes smooth, so that higher toner feeding power is provided.

For this reason, very little amount of the toner remains unused in the container 12. Since the blades 15*b* are in sliding contact with the internal wall of the container, the occurrence of coarse particle of the toner is prevented.

As described in the foregoing, the stirring blade 15*b* is rotated while being in sliding contact with the internal wall of the toner replenishing container 12, it would be considered that the toner cartridge C is rotated by the rotation of the stirring member 15. However, in this embodiment, the locking projection 17*c*1 is abutted to the jaw 25 of the cartridge mount 5*e* (FIG. 14B and FIG. 14C), the toner cartridge C is not rotated thereby, thus maintaining the position of the toner discharge opening 12*a* (particularly the angular position at the bottom edge) in a stabilized manner, thus stabilizing the toner supply amount and the image quality.

It is preferable that the bottom edge of the toner discharge opening 12*a* is within ±10 degrees, and more preferably ±5 degrees, when the horizontal direction of the center of the cylinder of the container 12 is 0 degree, when the cartridge C is mounted. In this embodiment, the angle is −3.6 degrees.

Demounting of the Toner Cartridge from the Developing Device

When the cartridge C is demounted from the developing device 5, the operator lowers the lever 17*c* of the grip 17 toward the gripping portion 17*b* from the position of use shown in FIG. 14*b* and 14*c* to release the engagement between the locking projection 17*c*1 and the end 25*a* of the jaw 25. The cartridge C is then rotated in the clockwise direction toward the mounting and demounting position (pose), thus returning the opening 12*a* to the top. Then, the toner cartridge C is pulled out of the cartridge mount 5*e*. At this time, the toner cartridge C is not pulled out unless it is rotated to the extent that the opening 12*a* is directed upward, conversely to the case of the toner cartridge C mounting.

The rotational direction of the toner cartridge C from the mounting and demounting position to the use position is opposite from that of the toner cartridge C from the use position to the mounting and demounting position. When the toner cartridge C is rotated from the use position to the mounting and demounting position, the projections 13*a*2 and 14*a*2 are moved to a position for the shutter member to close the opening 5*f*.

Throughout the mounting, using and demounting of the toner cartridge C, the outer surface of the toner replenishing container 12*a* and the shutter 20 are closely contacted so that sealing is maintained. Therefore, toner is not deposited on the outer peripheral surface of the toner cartridge C used up, when it is removed from the developing device 5, and therefore, the operator's hands and clothing are not contaminated with the toner. Therefore, it is easy to dispose of the toner cartridge C used up. As described hereinbefore, the toner feeding force of the stirring member 15 is high so that the remaining amount of toner in the used-up cartridge C is very small, and therefore, toner scattering or the like can be prevented while the used-up toner cartridge C is disposed of.

ANOTHER EMBODIMENT

Figure 16:
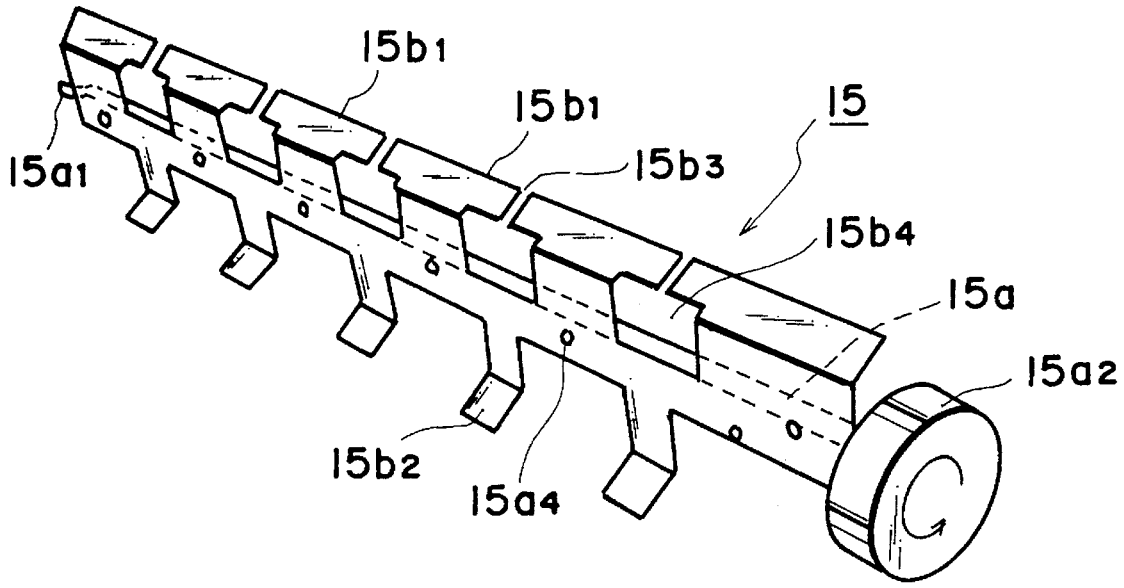
FIG. 16 illustrates another embodiment of the stirring member.

In the embodiment of FIG. 16, the main blade portion 15*b*1 and the auxiliary blade portion 15*b*2 are bent in a downstream direction with respect to the rotational direction of the stirring member 15. In this case, the end portion of the blade approaches obliquely to the toner, and therefore, the required torque of the stirring member 19 is reduced.

With this configuration of the stirring member 15, when the blade end approaches the toner discharging opening 12*a* and the toner is thrown by the rebounding of the blade, the horizontal component of the toner throwing is increased so that not only the force scooping the toner from the bottom of the container 12 to the toner discharge opening 12*a* but also the force for feeding the toner from the toner discharging opening 12*a* to the developing device 5 is increased.

In a compact developing device in which the developer chamber 5*a* and the cartridge mount 5*e* are substantially horizontal and parallel, the configuration of the stirring blade 15*b* is effective. If the blade 15*b* is bent in this manner, the contact angle between the end of the stirring blade and the internal wall of the toner supply chamber is relatively small as compared with the first embodiment, and the coarse particle occurrence of the toner is reduced.

When the stirring blade 15*b* is bent in this manner, the bending angle is preferably approx. 0–90 degrees, more preferably approx. 20–90 degrees, and most preferably 40–90 degrees, from the standpoint of reduction of the required torque and increase of the toner feeding force. In addition, the bent portion of the blade is positioned at approx. 50–95%, more preferably approx. 60–90% and most preferably approx. 70–80% of the total length of the blade away from the rotational axis.

The image bearing member on which toner image is formed by the developing device 5 is not limited to the photosensitive drum of the first embodiment. For example, it may be a photoconductor such as amorphous silicon, amorphous selenium, zinc oxide, titanium oxide or organic photoconductor (OPC) or the like. The configuration of the photosensitive member may be a drum, belt or sheet. Usually, a drum or belt is widely used. In the case of a drum type, it comprises an aluminum cylinder of aluminum alloy or the like and photoconductor evaporated or applied thereon.

In the first embodiment described in the foregoing, the exemplary image forming apparatus using the developing device 5 has been a copying machine. However, the present invention is applicable to another machine if toner is used to form an image, and more particularly it may be a laser beam printer, LED printer, facsimile machine or the like.

Experiment-1

Using the toner cartridge C of the first embodiment, a stirring member 15 of FIG. 5 is set in a toner replenishing container 12 of a cylindrical shape having an internal length of 322.5 mm and 55 mm. This is set in a developing device 5 of FIG. 2 after being filled with 380 g of one component toner, and the image forming test was carried out. The rotational speed of the stirring member 15 was 10.2 rpm. A 5.24% original of A4 size was used and image forming operations were continued in an intermitted durability test mode, while the amount of the toner in the developer chamber 5*a* and the toner amount in the container 12 were measured.

As for the toner amount in the developing device from the space in the developer chamber 5*a*, approx. 100 g is a proper amount. At the initial stage of image formation, the developer chamber 5*a* is empty, and therefore, a great amount of toner is supplied into the developer chamber 5*a* from the container 12, and therefore, the toner amount in the developer chamber 5*a* relatively quickly increases, but when 100 g is reached, the amount saturates and maintains at a constant level.

With continued image forming operation, the toner amount in the container 12 decreases, but the amount of toner in the developer chamber 5*a* is maintained at approx. 100 g. When the toner in the container 12 is used up, the amount of toner in the developer chamber 5*a* starts to decrease. The toner amount detecting means in the developer chamber is set to operate when the amount of toner in the developer chamber becomes 70 g or less, and when 70 g is reached, a display requesting the exchange of the container 12 is produced. Until this point, approx. 7000 sheets are subjected to the image forming operations.

As for amount of the toner in the developer chamber 5*a*, 70 g is sufficient to produce a good image even if the original is a solid black image original. Even if new toner is supplied by the exchange with fresh toner cartridge C, no reverse charge fog is produced due to self contamination.

Remaining amount in the toner of the container 12 after the completion of the image forming operations, has turned out to be as low as 3–5 g.

Similar tests were carried out using A4 size 25% original. The toner amount detecting means is operated when approx. 1500 sheets are processed. At this time, the remaining amount of toner in the container 12 was 5–10 g.

The relation between the toner remaining amount and the contamination is such that it is dependent on the configuration of the container 12, particularly the size of the toner discharge opening 12*a*. However, as described in the foregoing embodiment, when the opening 12*a* is as small as 7 mm, the toner hardly leaks or scatters during the disposal operation if the remaining amount is less than about 10 g.

Experiment-2

In Experiment-2, 380 g of toner is filled in a toner container 12 having the same structure as in Experiment-1. The stirring member 15 is continuously rotated for 10 hours at a speed of 10.2 rpm without opening the toner discharge opening 12*a*.

The continuous rotation for 10 hours correspond to 7000 sheets processing. At this time, the required torque is measured. It decreases at an initial stage, and a constant level is maintained thereafter without increase.

After rotation for 10 hours, the toner is taken out of the container 12, and filtered with 150 mesh (100 μm), and it has been confirmed that no coarse toner remains on the filter. The weight average particle size of the toner was 7.6 μm.

Experiment-3

Figure 17:
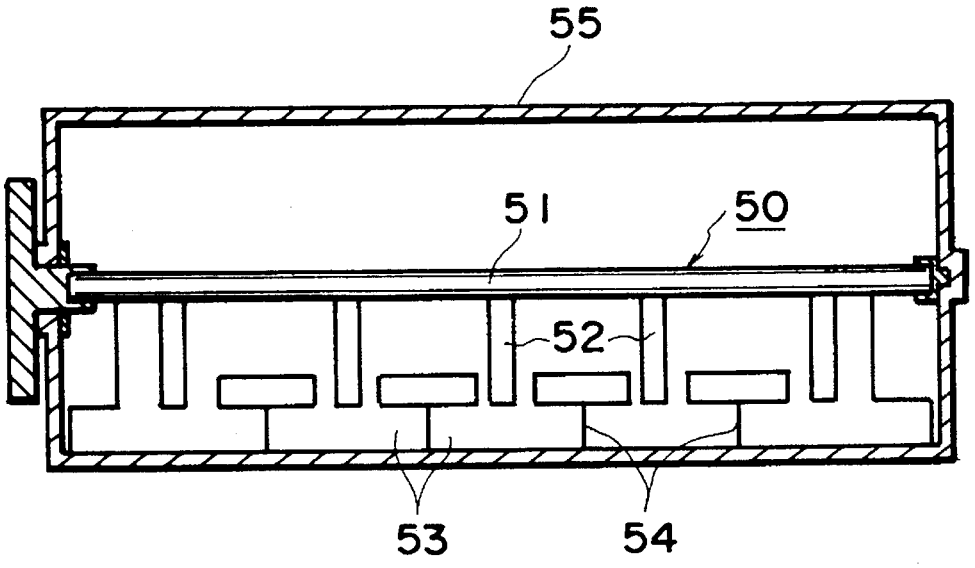
FIG. 17 illustrates a stirring member used in an experiment.

Similar experiments were carried out with the toner replenishing container 12 of Embodiment 1 but with a conventional stirring member shown in FIG. 17. The stirring member 50 comprises a rotational shaft 51, a toner feeding blade 53 and an elastic supporting member 52 therebetween.

A slide 54 extending in the radial direction is formed. The rotational radius of the toner feeding blade 53 has the same radius as the internal radius of the cylinder 55.

In the case of a 4% original of A4 size, the toner amount detecting means operated after 6300 sheets are processed, and the remaining amount of toner in the toner replenishing container was 10–20 g.

In the case of a 15% original of A4 size, 20–35 g of toner remains in the container. With this amount, the toner scatters when the container is inclined even slightly.

Then, the rotational speed of the stirring member was increased to 31.2 rpm. The remaining amount of toner decreased, but a small amount of coarse toner (large than 100 μm) remained on the filter in the experiments similar to the above-described Experiment-2.

While the invention has been described with reference to the structures disclosed herein, it is not confined to the details set forth and this application is intended to cover such modifications or changes as may come within the purposes of the improvements or the scope of the following claims.

What is claimed is:

1. A developer cartridge detachably mountable to a developing apparatus having a shutter for closing and opening a developer receiving opening, said developer cartridge comprising:

a cylindrical portion for accommodating developer, said cylindrical portion including an opening extending along a length thereof;

a sealing member for sealing the opening;

a first projection engagable with the shutter of the developing apparatus for moving the shutter to an open position for the developer receiving opening in interrelation with rotation of said developer cartridge in a first direction; and a second projection engageable with the shutter of the developing apparatus for moving the shutter to a closed position for the developer receiving opening in interrelation with rotation of said developer cartridge in a second direction which is opposite the first direction, wherein said first projection and said second projection project out of a longitudinal extension of the opening.

2. A developer cartridge according to claim 1, wherein said cylindrical portion has a polygonal cross-section.

3. A developer cartridge according to claim 1, wherein said cartridge has a flange at a longitudinal end, and said first projection and second projection are provided in the flange.

4. A developer cartridge according to claim 1, wherein said first projection and second projection each has a pair of projections, one of each pair being located at a rear portion in a cartridge inserting direction, and the other one of each pair being located at a front portion.

5. A developer cartridge according to claim 1, wherein said cylindrical portion is made of a resin material.

6. A developer cartridge according to claim 5, wherein the resin material has a thermoplastic property.

7. A developer cartridge according to claim 6, wherein the resin material is ABS resin material or polystylene material.

8. A developer cartridge according to claim 1, wherein said first projection and second projection are at positions interposing an extension of the opening therebetween.

9. A developer cartridge according to claim 8, wherein a line connecting a center of said cylindrical portion and a center of the opening in a direction perpendicular to a longitudinal direction thereof and a line connecting the center of said cylindrical portion and an end of said first projection adjacent to the opening form an angle which is in the range of 20–90 degrees, and the line connecting the center of said cylindrical portion and the center of the opening in the direction perpendicular to the longitudinal direction thereof and a line connecting the center of said cylindrical portion and an end of said second projection adjacent to the opening form an angle which is in the range of 70–160 degrees.

10. A developer cartridge according to claim 1, wherein said first projection and second projection are each provided with an end surface contactable to the shutter.

11. A developer cartridge according to claim 10, wherein the shutter is sandwiched by said first projection and second projection.

12. A developer cartridge according to claim 1, wherein said first projection and second projection determine the position of said cartridge upon mounting and demounting thereof.

13. A developer cartridge according to claim 1, wherein said first projection and second projection project out beyond an outer surface of said cylindrical portion.

14. A developer cartridge according to claim 13, wherein said first projection and said second projection project out beyond the outer surface of the cylindrical portion by an amount in the range of 2–10 mm.

15. A developer cartridge according to claim 1, further comprising feeding means for feeding developer in said cylindrical portion through said opening to the outside thereof.

16. A developer cartridge comprising:

a cylindrical portion for accommodating a developer, said cylindrical portion being provided with an opening extending in a direction of length of said cylindrical portion;

first and second pairs of projections extending out of an outer surface of said cylindrical portion, one of each of said first and second pairs being provided at one longitudinal end, and the other one of each of said first and second pairs being provided at the other longitudinal end;

wherein said first pair of projections and said second pair of projections are disposed interposing an extension of the opening therebetween at positions remote from the extension.

17. A developer cartridge according to claim 16, wherein said cylindrical portion has a circular cross-section.

18. A developer cartridge according to claim 16, wherein said cartridge has a flange at a longitudinal end, and said first pair of projections are provided in the flange.

19. A developer cartridge according to claim 16, wherein said cylindrical portion is made of a resin material.

20. A developer cartridge according to claim 19, wherein the resin material has a thermoplastic property.

21. A developer cartridge according to claim 20, wherein the resin material is ABS resin material or polystylene material.

22. A developer cartridge according to claim 16, wherein a line connecting a center of said cylindrical portion and a center of the opening in a direction perpendicular to a longitudinal direction thereof and a line connecting the center of said cylindrical portion and an end of said first projection adjacent to the opening forms an angle which is in the range of 20–90 degrees, and the line connecting the center of said cylindrical portion and the center of the opening in the direction perpendicular to the longitudinal direction thereof and a line connecting the center of said cylindrical portion and an end of said second projection adjacent to the opening form an angle which is in the range of 70–160 degrees.

23. A developer cartridge according to claim 16, wherein said first pair of projections and said second pair of projections determine the position of said cartridge upon mounting and demounting thereof.

24. A developer cartridge according to claim 16, wherein each of said first pair of projections and said second pair of projections projects out from the outer surface of said cylindrical portion by an amount in the range of 2–10 mm.

25. A developer cartridge according to claim 16, further comprising feeding means for feeding developer in said cylindrical portion through said opening to the outside thereof.

26. A developing apparatus comprising:

a developer carrying member for carrying a developer for developing an electrostatic image on an image bearing member;

a developer container for containing a developer to be carried on said developer carrying member, said developer container including a developer receiving portion for receiving developer;

a shutter for opening and closing said developer receiving portion; and a developer cartridge detachably mountable to said developer container for supplying developer to said developer container through the developer receiving portion said cartridge comprising:

a cylindrical portion for accommodating a developer, said cylindrical portion being provided with an opening extending along a length thereof;

a sealing member for sealing the opening;

a first projection engageable with said shutter for moving the shutter to an open position for the developer receiving opening in interrelation with rotation of said developer cartridge in a first direction; and a second projection engagable with said shutter for moving the shutter to a closed position for the developer receiving opening in interrelation with rotation of said developer cartridge in a second direction which is opposite the first direction, said first projection and said second projection projecting out of a longitudinal extension of the opening.

27. An apparatus according to claim 26, wherein said cylindrical portion has a circular cross-section.

28. An apparatus according to claim 26, wherein said cartridge has a flange at a longitudinal end, and said first projection and second projection are provided in the flange.

29. An apparatus according to claim 26, wherein said first projection and second projection each has a pair of projections, one of each pair being located at a rear portion in a cartridge inserting direction, and the other one of each pair being located at a front portion.

30. An apparatus according to claim 26, wherein said cylindrical portion is made of a resin material.

31. An apparatus according to claim 30, wherein the resin material has a thermoplastic property.

32. An apparatus according to claim 31, wherein the resin material is ABS resin material or polystylene material.

33. An apparatus according to claim 26, wherein said first projection and second projection are at positions interposing an extension of the opening therebetween.

34. An apparatus according to claim 33, wherein a line connecting a center of said cylindrical portion and a center of the opening in a direction perpendicular to a longitudinal direction thereof and a line connecting the center of said cylindrical portion and an end of said first projection adjacent to the opening form an angle which is in the range of 20–90 degrees, and the line connecting the center of said cylindrical portion and the center of the opening in the direction perpendicular to the longitudinal direction thereof and a line connecting the center of said cylindrical portion and an end of said second projection adjacent to the opening form an angle which is in the range of 70–160 degrees.

35. An apparatus according to claim 26, wherein said first projection and second projection are each provided with an end surface contactable to the shutter.

36. An apparatus according to claim 35, wherein the shutter is sandwiched by said first projection and second projection.

37. An apparatus according to claim 26, further comprising guiding means for guiding mounting or demounting of said cartridge, said guiding means including a first guiding portion having a first projection and a second guiding portion having a second projection.

38. An apparatus according to claim 37, wherein said guide means guides said cartridge to a position in which the opening is at an upper portion when the cartridge is mounted or demounted.

39. An apparatus according to claim 26, wherein said first projection and second projection project out beyond an outer surface of said cylindrical portion.

40. An apparatus according to claim 39, wherein said first projection and said second projection project out beyond the outer surface by an amount in the range of 2–10 mm.

41. An apparatus according to claim 26, further comprising feeding means for feeding developer in said cylindrical portion through said opening to the outside thereof.

42. An apparatus according to claim 26, further comprising feeding means for feeding developer from said developer container to said developer carrying member.

* * * * *

UNITED STATES PATENT AND TRADEMARK OFFICE

CERTIFICATE OF CORRECTION

PATENT NO. : 5,579,101 Page 1 of 4

DATED : November 26, 1996

INVENTOR(S) : KAZUHIKO OMATA, ET AL.

It is certified that error appears in the above-indentified patent and that said Letters Patent is hereby corrected as shown below:

COLUMN 2:

Line 63, "engaged" should read --the engaged--.

COLUMN 3:

Line 4, "to" should read --into--.

COLUMN 4:

Line 3, delete "a". (2nd Occurrence)

COLUMN 5:

Line 12, "relative" should read --relatively--.
Line 14, "lene" should read --rene--; and "Beside" should read --Besides--.
Line 38, "Nylon," should read --nylon,--.
Line 67, "i.e. 13a1" should read --i.e., projection 13a1--; and "13a2" should read --13a2,--.

UNITED STATES PATENT AND TRADEMARK OFFICE

CERTIFICATE OF CORRECTION

PATENT NO. : 5,579,101

DATED : November 26, 1996

INVENTOR(S) : KAZUHIKO OMATA, ET AL.

It is certified that error appears in the above-indentified patent and that said Letters Patent is hereby corrected as shown below:

COLUMN 6:

Line 1, "and," should read --and--.
Line 25, delete "meld".

COLUMN 8:

Line 53, delete "by".
Line 54, delete "which".

COLUMN 9:

Line 12, delete "by which".

COLUMN 12:

Line 20, "a" should read --are--.
Line 26, delete "by which".

UNITED STATES PATENT AND TRADEMARK OFFICE

CERTIFICATE OF CORRECTION

PATENT NO. : 5,579,101 Page 3 of 4

DATED : November 26, 1996

INVENTOR(S) : KAZUHIKO OMATA, ET AL.

It is certified that error appears in the above-indentified patent and that said Letters Patent is hereby corrected as shown below:

COLUMN 15:

Line 27, "deforms" should read --deforms,--; and "automatically" should read --automatic--.

COLUMN 16:

Line 17, "particle" should read --particles--.
Line 42, "FIG." should read --FIGS.--.
Line 64, "toner cartridge C used up," should read --used-up toner cartridge C,--.

COLUMN 17:

Line 1, "toner cartridge C used up." should read --used-up toner cartridge C. --".

COLUMN 18:

Line 24, "amount of the toner" should read --the amount of toner--.
Line 28, "is produced due to self contamination." should read --due to self contamination is produced.--.

UNITED STATES PATENT AND TRADEMARK OFFICE

CERTIFICATE OF CORRECTION

PATENT NO. : 5,579,101 Page 4 of 4

DATED : November 26, 1996

INVENTOR(S) : KAZUHIKO OMATA, ET AL.

It is certified that error appears in the above-indentified patent and that said Letters Patent is hereby corrected as shown below:

COLUMN 18: (continued)

Line 29, "Remaining amount in the toner of the container" should read --The remaining amount of toner in the container--.

Line 52, "correspond" should read --corresponds--.

57, "with" should read --by--.

COLUMN 19:

Line 5, "are" should read --were--.

Line 58, "polystylene" should read --polystyrene--.

COLUMN 20:

Line 52, "polystylene" should read --polystyrene--.

COLUMN 22:

Line 7, "polystylene" should read --polystyrene--.

Signed and Sealed this

Fourteenth Day of October, 1997

Bruce Lehman

*Attest:*

BRUCE LEHMAN

*Attesting Officer*

*Commissioner of Patents and Trademarks*